US007219977B2

(12) United States Patent
Mitsuzawa

(10) Patent No.: US 7,219,977 B2
(45) Date of Patent: May 22, 2007

(54) PRINTING APPARATUS, LIQUID EJECTING APPARATUS, METHOD OF ADJUSTING POSITIONS OF LIQUID DROPLET MARKS, AND LIQUID EJECTING SYSTEM

(75) Inventor: Toyohiko Mitsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 420 days.

(21) Appl. No.: 10/824,430

(22) Filed: Apr. 15, 2004

(65) Prior Publication Data

US 2004/0263550 A1 Dec. 30, 2004

Related U.S. Application Data

(63) Continuation of application No. 10/686,772, filed on Oct. 17, 2003.

(30) Foreign Application Priority Data

Oct. 17, 2002 (JP) ..... 2002-303372
Apr. 16, 2003 (JP) ..... 2003-111552

(51) Int. Cl.
*B41J 2/21* (2006.01)
*B41J 29/38* (2006.01)

(52) U.S. Cl. ..... 347/43; 347/12

(58) Field of Classification Search ..... 347/43, 347/12

See application file for complete search history.

(56) References Cited

U.S. PATENT DOCUMENTS 4,520,367 A 5/1985 Ishikawa et al.
4,617,580 A 10/1986 Miyakawa
4,839,674 A 6/1989 Hanagata et al.
4,975,780 A 12/1990 Kuboki
5,216,442 A 6/1993 Parks et al.
5,793,397 A 8/1998 Barker et al.
5,988,784 A 11/1999 Takemura et al.
6,116,795 A 9/2000 Ogasawara
6,196,736 B1 * 3/2001 Otsuki et al. ..... 347/19
6,234,602 B1 5/2001 Soto et al.

(Continued)

FOREIGN PATENT DOCUMENTS

JP 9-262992 A 10/1997

(Continued)

OTHER PUBLICATIONS

W.G. McLean and E. W.Nelson,, "Impulse and Momentum", Engineering Mechanics: Statics and Dynamics, 1952, Schaum Publishing Co., 2nd edition, p. 286.

*Primary Examiner*—Julian D. Huffman
(74) *Attorney, Agent, or Firm*—Sughrue Mion, PLLC

(57) ABSTRACT

A printing apparatus comprises a plurality of print heads, a moving member that can be moved and that is provided with the plurality of print heads, and a feed mechanism for feeding a medium to be printed. Dots for correcting a feed amount by which the feed mechanism feeds the medium to be printed are formed on the medium to be printed by ejecting ink from a predetermined print head, among the plurality of print heads, while moving the moving member. The predetermined print head is a print head other than the print head, among the plurality of print heads, that is the most susceptible to vibration caused by moving the moving member.

17 Claims, 18 Drawing Sheets

U.S. PATENT DOCUMENTS

| | | | | |
|---|---|---|---|---|
| 6,416,153 | B1 | 7/2002 | Pan et al. | |
| 6,439,684 | B1 | 8/2002 | Yoshimura et al. | |
| 6,454,474 | B1 | 9/2002 | Lesniak et al. | |
| 6,467,867 | B1 | 10/2002 | Worthington et al. | |
| 6,530,647 | B2 * | 3/2003 | Kubota et al. | 347/43 |
| 6,561,615 | B2 | 5/2003 | Okawa et al. | |
| 6,568,784 | B2 | 5/2003 | Izumi et al. | |
| 6,641,224 | B1 | 11/2003 | Heck et al. | |
| 6,769,759 | B2 | 8/2004 | Yamasaki et al. | |
| 6,789,872 | B2 | 9/2004 | Ioka et al. | |
| 6,905,186 | B2 | 6/2005 | Kojima | |
| 7,083,249 | B2 | 8/2006 | Iwao | |

FOREIGN PATENT DOCUMENTS

| | | | |
|---|---|---|---|
| JP | 2000-158735 | A | 6/2000 |
| JP | 2000/326554 | A | 11/2000 |

* cited by examiner

PRINTING APPARATUS, LIQUID EJECTING APPARATUS, METHOD OF ADJUSTING POSITIONS OF LIQUID DROPLET MARKS, AND LIQUID EJECTING SYSTEM

CROSS-REFERENCE TO RELATED APPLICATION

This application is a continuation-in-part of application Ser. No. 10/686,772, filed Oct. 17, 2003, the disclosure of which is incorporated herein by reference. The present application claims priority upon Japanese Patent Application No. 2002-303372 filed on Oct. 17, 2002 and Japanese Patent Application No. 2003-111552 filed on Apr. 16, 2003, which are herein incorporated by reference.

BACKGROUND OF THE INVENTION

1. Field of the Invention

The present invention relates to printing apparatuses, liquid ejecting apparatuses, methods of adjusting positions of liquid droplet marks, and liquid ejecting systems.

2. Description of the Related Art (1) In recent years, color inkjet printers that eject several colors of ink from a print head so as to form ink dots on print paper have become popular as output devices for computers. More recently, relatively large color inkjet printers that use a plurality of print heads to print onto print paper such as roll paper have also been achieved (for example, see JP 2000-158735A). Such color inkjet printers eject ink from the print heads while moving a carriage so as to form dots on the print paper for correcting the feed amount by which the print paper is fed by a paper feed roller.

When moving the carriage and forming dots for correcting the feed amount on the print paper, vibration occurs in the carriage. Since the print heads are provided in the carriage, that vibration is transmitted to the print heads.

Under these circumstances, when ink is ejected from the print heads to form dots for correcting the feed amount on the print paper, desired dots are not obtained, and therefore there is the possibility that correction of the feed amount cannot be carried out appropriately.

(2) Inkjet printers that include recording heads (as liquid ejecting section groups) for ejecting ink (as an example of liquid) and that perform printing by forming dots (as liquid droplet marks) on a medium with the ejected ink are known as liquid ejecting apparatuses having a plurality of liquid ejecting section groups (for example, see JP 9-262992A). Some of them are large-sized inkjet printers that perform high-speed printing on large-sized print paper (such as JIS standard A0 sized paper, B0 sized paper, and roll paper) using the plurality of recording heads. Such a large-sized inkjet printer ejects ink to perform printing while a carriage, in which the recording heads are arranged at appropriate intervals to comply with the size of the paper to be printed, is being moved by predetermined moving means.

When the carriage is moved by the moving means, an external force is applied to a predetermined position of the carriage. This results in bringing about a difference between the behavior of a recording head that is arranged on the side close to the position to which the external force is applied and the behavior of a recording head arranged on the side away from that position when the carriage being moved. Under these circumstances, there is a possibility that the positions of the dots formed on the print paper by the ink ejected from the recording heads are misaligned from initially-set target positions due to this difference in behavior, and that quality in image deteriorates.

SUMMARY OF THE INVENTION

The present invention was arrived at in light of the foregoing problems.

(1) An object of the present invention is to achieve a printing apparatus with which correction of the feed amount can be carried out appropriately.

(2) Another object of the present invention is to achieve a liquid ejecting apparatus that is capable of adjusting positions of liquid droplet marks formed on a medium by each liquid ejecting section group, a method of adjusting the positions of the liquid droplet marks, and a liquid ejecting system that is capable of adjusting the positions of the liquid droplet marks.

According to an aspect of the present invention, a printing apparatus comprises:

a plurality of print heads;

a moving member that can be moved and that is provided with the plurality of print heads; and a feed mechanism for feeding a medium to be printed;

wherein dots for correcting a feed amount by which the feed mechanism feeds the medium to be printed are formed on the medium to be printed by ejecting ink from a predetermined print head, among the plurality of print heads, while moving the moving member, and wherein the predetermined print head is a print head other than the print head, among the plurality of print heads, that is the most susceptible to vibration caused by moving the moving member.

According to another aspect of the present invention, a liquid ejecting apparatus comprises:

a moving member that has at least two liquid ejecting section groups and that is capable of moving in a predetermined direction due to an external force, each of the liquid ejecting section groups including at least two liquid ejecting sections for ejecting liquid droplets to form liquid droplet marks on a medium, and each of the liquid ejecting section groups being driven based on a single reference ejection signal for causing the liquid droplets to be ejected from the liquid ejecting sections;

a reference liquid ejecting section group, among the liquid ejecting section groups, that is driven according to the reference ejection signal therefor at a predetermined reference timing and that is a liquid ejecting section group other than the liquid ejecting section group, among the liquid ejecting section groups, that is the most susceptible to vibration caused by moving the moving member; and at least one other liquid ejecting section group, among the liquid ejecting section groups, that is driven according to the reference ejection signal therefor at a timing adjusted based on the predetermined reference timing of the reference liquid ejecting section group.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
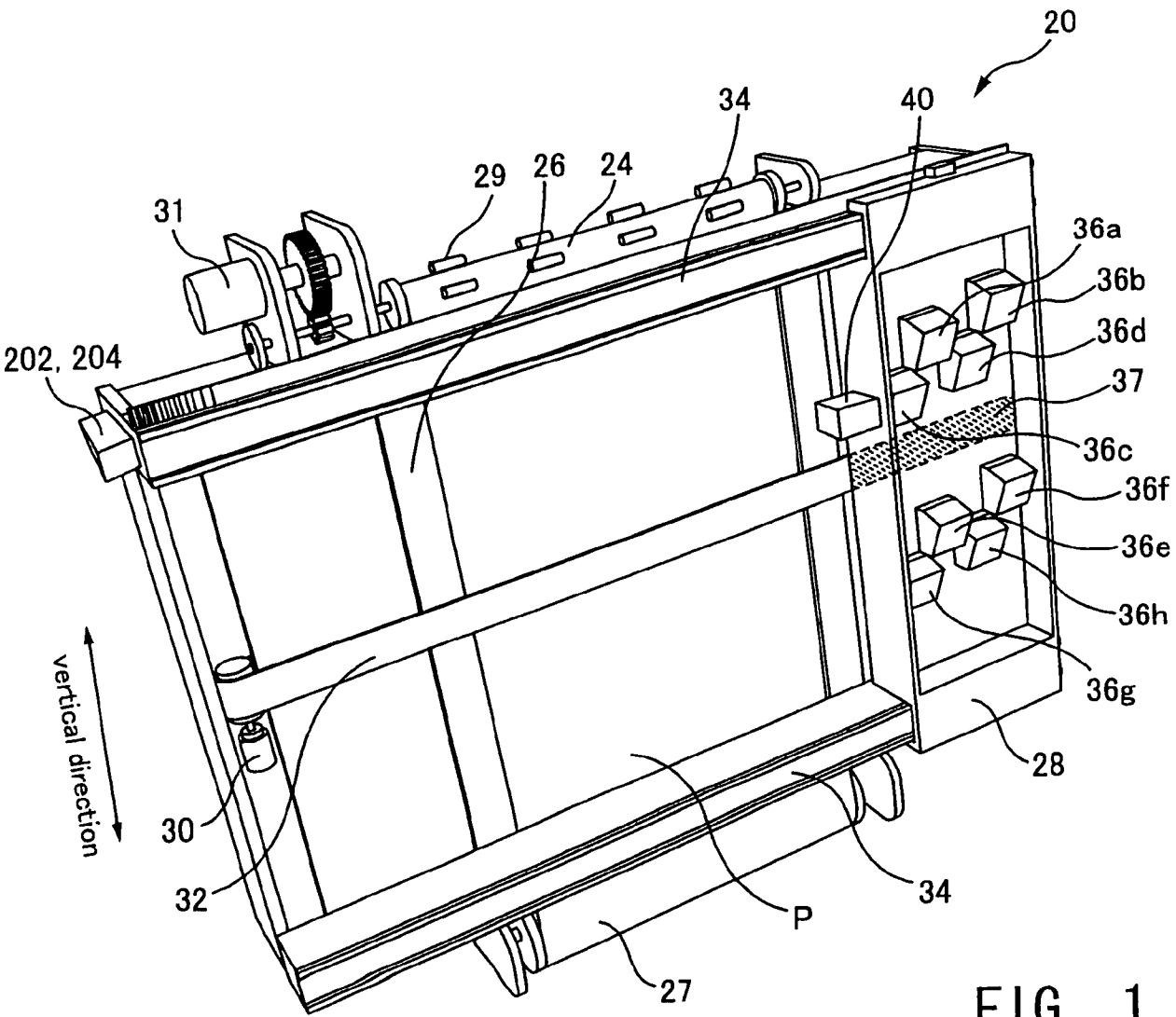
FIG. 1 is a perspective view showing an overview of a color inkjet printer 20 according to an embodiment of the present invention.

At least the following matters will be made clear by the explanation in the present specification and the description of the accompanying drawings.

(1) According to an aspect of the present invention, a printing apparatus comprises: a plurality of print heads; a moving member that can be moved and that is provided with the plurality of print heads; and a feed mechanism for feeding a medium to be printed; wherein dots for correcting a feed amount by which the feed mechanism feeds the medium to be printed are formed on the medium to be printed by ejecting ink from a predetermined print head, among the plurality of print heads, while moving the moving member, and wherein the predetermined print head is a print head other than the print head, among the plurality of print heads, that is the most susceptible to vibration caused by moving the moving member.

It is preferable that the dots for correcting the feed amount by which the medium to be printed is fed are formed using the print head that is the least susceptible to vibration. However, it is still possible to suitably correct the feed amount by which the medium to be printed is fed even if the dots for correction are formed using a print head other than the print head that is the most susceptible to the vibration.

Further, it is possible that the predetermined print head is the print head, among the plurality of print heads, that is the least susceptible to the vibration caused by moving the moving member.

By adopting the print head, among the plurality of print heads, that is least likely to be susceptible to vibration caused by moving the moving member as the predetermined print head, correction of the feed amount can be carried out more appropriately.

Further, it is possible that the printing apparatus further comprises a drive member that is connected to the moving member and that is for driving the moving member; and the predetermined print head is the print head that is located the closest to a connecting section at which the moving member and the drive member are connected to each other.

Doing this allows the print head that is the least susceptible to the vibration to be more easily selected.

Further, it is possible that the dots for correcting the feed amount by which the feed mechanism feeds the medium to be printed are formed on both edge sections of the medium to be printed by ejecting ink from the predetermined print head, among the plurality of print heads, while moving the moving member.

By doing this, it is possible to find a more accurate correction amount, and therefore more appropriate correction can be implemented.

Further, it is possible that the dots for correcting the feed amount by which the feed mechanism feeds the medium to be printed are formed on the medium to be printed by ejecting ink from predetermined nozzles provided in the predetermined print head.

By doing this, there is the advantage that error due to changing the nozzles that eject ink will not occur.

Further, it is possible that the printing apparatus further comprises: a support member for supporting the medium to be printed; a suction member for sucking the medium to be printed toward the support member; and a first detector for detecting a force by which the suction member sucks the medium to be printed; and that whether or not to form, on the medium to be printed, the dots for correcting the feed amount by which the feed mechanism feeds the medium to be printed is determined according an output value of the first detector.

Doing this allows the dots for correcting the feed amount by which the medium to be printed is fed by the feed mechanism to be formed on the medium to be printed at an appropriate timing.

Further, it is possible that whether or not to form, on the medium to be printed, the dots for correcting the feed amount by which the feed mechanism feeds the medium to be printed is determined according at least one of a value of a temperature around the printing apparatus and a value of a humidity around the printing apparatus.

Doing this allows the dots for correcting the feed amount by which the medium to be printed is fed by the feed mechanism to be formed on the medium to be printed at an appropriate timing.

Further, it is possible that the dots for correcting the feed amount by which the feed mechanism feeds the medium to be printed are formed on the medium to be printed when power is supplied to the printing apparatus.

Doing this allows the implementation of appropriate correction to be assured.

Further, it is possible that the dots for correcting the feed amount by which the feed mechanism feeds the medium to be printed are formed on the medium to be printed during a printing operation of the printing apparatus.

Doing this allows the dots to be efficiently formed on the medium to be printed.

Further, it is possible that the dots for correcting the feed amount by which the feed mechanism feeds the medium to be printed are formed on the medium to be printed when the medium to be printed has been exchanged.

Doing this allows the implementation of appropriate correction to be assured.

Further, it is possible that the printing apparatus further comprises: a second detector for detecting whether or not the medium to be printed has been exchanged; and that when it has been detected by the second detector that the medium to be printed has been exchanged, the dots for correcting the feed amount by which the feed mechanism feeds the medium to be printed are formed on the medium to be printed.

In this way, whether or not the medium to be printed has been exchanged can be detected using a simple method.

Further, it is possible that the dots for correcting the feed amount by which the feed mechanism feeds the medium to be printed are formed on the medium to be printed when a print mode of the printing apparatus has been changed.

Doing this allows the implementation of appropriate correction to be assured.

Further, it is possible that at least two correction amounts for correcting the feed amount by which the feed mechanism feeds the medium to be printed are obtained based on the dots formed on the medium to be printed, and that, based on an average value of the correction amounts that are obtained, the feed amount by which the feed mechanism feeds the medium to be printed is corrected.

Doing this allows more accurate correction to be carried out.

It is also possible to achieve a printing apparatus comprising: a plurality of print heads; a moving member that can be moved and that is provided with the plurality of print heads; and a feed mechanism for feeding a medium to be printed; wherein dots for correcting a feed amount by which the feed mechanism feeds the medium to be printed are formed on both edge sections of the medium to be printed by ejecting ink from a predetermined print head, among the plurality of print heads, while moving the moving member; wherein the predetermined print head is the print head, among the plurality of print heads, that is the least susceptible to vibration caused by moving the moving member; wherein the printing apparatus further comprises a drive member that is connected to the moving member and that is for driving the moving member; wherein the predetermined print head is the print head that is located the closest to a connecting section at which the moving member and the drive member are connected to each other; wherein the printing apparatus further comprises: a support member for supporting the medium to be printed; a suction member for sucking the medium to be printed toward the support member; and a detector for detecting a force by which the suction member sucks the medium to be printed; wherein whether or not to form, on the medium to be printed, the dots for correcting the feed amount by which the feed mechanism feeds the medium to be printed is determined according an output value of the detector; and wherein whether or not to form, on the medium to be printed, the dots for correcting the feed amount by which the feed mechanism feeds the medium to be printed is determined according at least one of a value of a temperature around the printing apparatus and a value of a humidity around the printing apparatus.

In this way, most of the primary effects already mentioned can be obtained, and therefore the object of the present invention is more effectively achieved.

(2) Another aspect of the present invention is a liquid ejecting apparatus comprising: a moving member that has at least two liquid ejecting section groups and that is capable of moving in a predetermined direction due to an external force, each of the liquid ejecting section groups including at least two liquid ejecting sections for ejecting liquid droplets to form liquid droplet marks on a medium, and each of the liquid ejecting section groups being driven based on a single reference ejection signal for causing the liquid droplets to be ejected from the liquid ejecting sections; a reference liquid ejecting section group, among the liquid ejecting section groups, that is driven according to the reference ejection signal therefor at a predetermined reference timing and that is a liquid ejecting section group other than the liquid ejecting section group, among the liquid ejecting section groups, that is the most susceptible to vibration caused by moving the moving member; and at least one other liquid ejecting section group, among the liquid ejecting section groups, that is driven according to the reference ejection signal therefor at a timing adjusted based on the predetermined reference timing of the reference liquid ejecting section group.

According to such a liquid ejecting apparatus, the timing of the reference ejection signal for each of a plurality of liquid ejecting section groups is adjusted based on a predetermined reference timing of a liquid ejecting section group which is a liquid ejecting section group other than the liquid ejecting section group, among the liquid ejecting section groups, that is the most susceptible to vibration caused by moving the moving member. In other words, adjustment is made based on a liquid ejecting section group whose behavior upon movement is stable. Therefore, the positions at which the liquid droplet marks are formed by the other liquid ejecting section group is adjusted based on liquid droplet marks that are formed at stable positions, and thus, it becomes possible to reduce positional misalignment and variations between the liquid droplet marks formed by the reference liquid ejecting section group and each of the other liquid ejecting section groups.

Further, in the above-described liquid ejecting apparatus, it is preferable that the reference liquid ejecting section group is positioned on a side, in a direction intersecting with the predetermined direction, that is close to a section, in the moving member, to which the external force is applied.

According to such a liquid ejecting apparatus, the timing of the reference ejection signal for each of a plurality of liquid ejecting section groups is adjusted based on a predetermined reference timing of a liquid ejecting section group that is positioned on a side, in a direction intersecting with the predetermined direction, that is close to a section, in the moving member, to which the external force is applied, that is, the liquid ejecting section group that is positioned close to the section where the behavior upon movement is stable. Therefore, the positions at which the liquid droplet marks are formed by the other liquid ejecting section group is adjusted based on liquid droplet marks that are formed at stable positions, and thus, it becomes possible to reduce positional misalignment and variations between the liquid droplet marks formed by the reference liquid ejecting section group and each of the other liquid ejecting section groups.

Further, in the above-described liquid ejecting apparatus, it is preferable that the reference liquid ejecting section group is positioned on a side that is close to a center of the section to which the external force is applied.

According to such a liquid ejecting apparatus, even when the moving member moves, for example, in different directions, the timing adjustment is carried out based on the timing of a liquid ejecting section group that is stable in behavior during movement in both directions. Therefore, it is possible to further reduce the variations in the positions of the liquid droplet marks formed on the medium with each of the liquid ejecting section groups.

Further, in the above-described liquid ejecting apparatus, the liquid ejecting section groups may be liquid ejecting section rows, each of the liquid ejecting section rows including the liquid ejecting sections aligned in a row in a carrying direction in which the medium is carried.

With this structure, each liquid ejecting section row, in which the liquid ejecting sections are aligned in a row in the carrying direction, is driven based on a single reference ejection signal therefor. Therefore, all of the liquid ejecting section rows can be adjusted based on the timing of the liquid ejecting section row that is positioned on the side close to the section to which the external force is applied and whose behavior is thus stable. Accordingly, by adjusting each of the liquid ejecting section rows, it becomes possible to reduce variations in positions of the liquid droplet marks for the entire liquid ejecting apparatus.

Further, in the above-described liquid ejecting apparatus, the liquid ejecting section groups may be liquid ejecting units, each of the liquid ejecting units including at least two liquid ejecting section rows aligned in the predetermined direction, and each of the liquid ejecting section rows including the liquid ejecting sections aligned in a row in a carrying direction in which the medium is carried. According to such a liquid ejecting apparatus, it becomes possible to make adjustments on a liquid ejecting unit basis, and therefore, adjustment can be controlled easily.

Further, in the above-described liquid ejecting apparatus, it is preferable that the timing for driving the other liquid ejecting section group is adjusted to make a reference liquid droplet mark row that is taken as a reference and that is formed in a carrying direction, in which the medium is carried, by the reference liquid ejecting section group ejecting liquid at the predetermined reference timing while moving and a liquid droplet mark row that is formed by the other liquid ejecting section group ejecting liquid while moving be continuous with each other.

According to such a liquid ejecting apparatus, adjustment is carried out such that a reference liquid droplet mark row that is taken as a reference and that is formed in the carrying direction and a liquid droplet mark row formed by the other liquid ejecting section group are continuous with each other. Therefore, visibility of the amount of misalignment with respect to the reference is satisfactory, and thus, adjustment can be carried out easily.

Further, in the above-described liquid ejecting apparatus, it is preferable that the liquid ejecting apparatus carries the medium between an action of forming the reference liquid droplet mark row and an action of forming the liquid droplet mark row with the other liquid ejecting section group.

According to such a liquid ejecting apparatus, the medium is carried between the action of ejecting liquid from the reference liquid ejecting section group and the action of ejecting liquid from the other liquid ejecting section group. Accordingly, it becomes possible to make adjustments taking into account also the positional misalignment between liquid droplet marks that occurs due to factors relating to medium-carrying precision.

Further, if ink is adopted as the liquid used in the liquid ejecting apparatus, then it is possible to achieve a printing apparatus that is capable of printing high quality images with liquid ejecting section groups in which the variations in positions of the dots with respect to the medium have been reduced entirely.

Further, in the above-described liquid ejecting apparatus, it is preferable that each of the liquid ejecting section groups has an achromatic color liquid ejecting section row for ejecting achromatic color ink as the liquid and a chromatic color liquid ejecting section row for ejecting chromatic color ink; and the timing for driving the other liquid ejecting section group is adjusted differently for when the liquid droplet marks are to be formed on the medium by ejecting ink from the achromatic color liquid ejecting section row, and when the liquid droplet marks are to be formed on the medium using the chromatic color liquid ejecting section row.

Achromatic color ink is mainly used for printing texts etc. and is of a single color, and therefore, it is preferable to adjust the timing for ejecting the achromatic color ink. On the other hand, chromatic color ink is mainly used for printing, for example, natural pictures such as photographs, and a plurality of colors of inks are used therefor, and therefore, it is preferable to adjust the timing for ejecting the inks of the plurality of colors. However, the timing to be adjusted is different for when the achromatic color ink is used and for when the chromatic color inks are used. According to the liquid ejecting apparatus described above, it becomes possible to print all types of images, such as texts and natural pictures, with high quality by adjusting the timing differently for when liquid droplet marks are formed using achromatic color ink and for when liquid droplet marks are formed using chromatic color ink(s).

Further, in the above-described liquid ejecting apparatus, it is preferable that when the positions of the liquid droplet marks are to be adjusted for performing printing on the medium by ejecting ink from the achromatic color liquid ejecting section row, the timing for driving the other liquid ejecting section group is adjusted according to liquid droplet marks that are formed by the ink ejected from the achromatic color liquid ejecting section row.

According to such a liquid ejecting apparatus, the adjustment of the positions of the liquid droplet marks for performing printing using achromatic color ink is carried out by adjusting the timing based on the liquid droplet marks actually formed by ejecting ink from the achromatic color liquid ejecting section row. Therefore, it becomes possible to carry out adjustment for printing using achromatic color ink more appropriately. Accordingly, it becomes possible to print satisfactory images using achromatic color ink.

Further, in the above-described liquid ejecting apparatus, it is preferable that each of the liquid ejecting section groups has at least two chromatic color liquid ejecting section rows, each for ejecting a different one of at least two chromatic color inks as the liquid; and when the positions of the liquid droplet marks are to be adjusted for performing printing on the medium by ejecting ink from the chromatic color liquid ejecting section rows, the timing for driving the other liquid ejecting section group is adjusted according to liquid droplet mark rows that are formed by the inks ejected from the chromatic color liquid ejecting section rows.

According to such a liquid ejecting apparatus, the adjustment of the positions of the liquid droplet marks for performing printing using chromatic color ink is carried out by adjusting the timing based on the liquid droplet marks actually formed by ejecting ink from the chromatic color liquid ejecting section rows. Therefore, it becomes possible to carry out adjustment for printing using chromatic color ink more appropriately. Accordingly, it becomes possible to print satisfactory images using chromatic color ink.

Further, in the above-described liquid ejecting apparatus, it is preferable that the liquid ejecting section rows in the same one of the liquid ejecting section groups are driven based on the single reference ejection signal; and the timing for driving the other liquid ejecting section group is adjusted to make a distance, in the predetermined direction, between the liquid droplet mark rows, among the liquid droplet mark rows formed by ejecting the inks from the chromatic color liquid ejecting section rows, that are formed using ink of one predetermined color and a distance, in the predetermined direction, between the liquid droplet mark rows, among the liquid droplet mark rows formed by ejecting the inks from the chromatic color liquid ejecting section rows, that are formed using ink of another predetermined color be approximately equal.

According to such a liquid ejecting apparatus, it becomes possible to improve the quality of images printed using chromatic color inks by adjusting the positions of the liquid droplet marks formed using predetermined inks, among the plurality of chromatic color inks, that tend to affect image quality, for example. Particularly, the timing is adjusted such that the distances, in the moving direction, between the liquid droplet mark rows formed using the predetermined inks are approximately equal. Therefore, variations in positions of the liquid droplet marks due to difference in ink color are reduced, and thus, it becomes possible to print further improved images using chromatic color inks.

Further, in the above-described liquid ejecting apparatus, it is preferable that the inks of the predetermined colors are magenta-type ink and cyan-type ink.

According to such a liquid ejecting apparatus, the positions of the liquid droplet marks that are formed using magenta-type ink and cyan-type ink, which tend to affect image quality particularly when natural pictures etc. are printed, are adjusted. Therefore, it becomes possible to further improve the quality of images printed using chromatic color inks.

Further, in the above-described liquid ejecting apparatus, it is preferable that the liquid ejecting sections for ejecting the chromatic color ink to adjust the positions of the liquid droplet marks are a portion of the liquid ejecting sections of the chromatic color liquid ejecting section row.

When natural pictures, for example, for which chromatic color inks are particularly used are printed, ink is seldom ejected from all of the liquid ejecting sections. Therefore, by forming liquid droplet marks, which are formed for timing adjustment, by ejecting ink from only some of the liquid ejecting sections of a liquid ejecting section row, it is possible to adjust the positions of the liquid droplet marks with substantially the same conditions as those for when actual printing is performed. Accordingly, it is possible to make adjustments that suit printing using chromatic color inks even more.

Another aspect of the present invention is a liquid ejecting apparatus comprising: a moving member that has at least two ink ejecting units and that is capable of moving in a predetermined direction due to an external force, each of the ink ejecting units including at least two ink ejecting section rows aligned in the predetermined direction, each of the ink ejecting section rows including at least two ink ejecting sections that are for ejecting ink droplets to form ink droplet marks on a medium and that are aligned in a row in a carrying direction in which the medium is carried, and each of the ink ejecting units being driven based on a single reference ejection signal for causing the ink droplets to be ejected from the ink ejecting sections; a reference ink ejecting unit, among the ink ejecting units, that is driven according to the reference ejection signal therefor at a predetermined reference timing and that is an ink ejecting unit other than the ink ejecting unit, among the ink ejecting units, that is the most susceptible to vibration caused by moving the moving member; and at least one other ink ejecting unit, among the ink ejecting units, that is driven according to the reference ejection signal therefor at a timing adjusted based on the predetermined reference timing of the reference ink ejecting unit, wherein: the reference ink ejecting unit is positioned on a side, in a direction intersecting with the predetermined direction, that is close to a center of a section, in the moving member, to which the external force is applied; each of the ink ejecting units has an achromatic color ink ejecting section row for ejecting achromatic color ink and at least two chromatic color ink ejecting section rows each for ejecting a different one of at least two chromatic color inks; a reference ink droplet mark row that is taken as a reference and that is formed in the carrying direction by the reference ink ejecting unit ejecting ink at the predetermined reference timing while moving and an ink droplet mark row that is formed by the other ink ejecting unit ejecting ink while moving are formed, one of either the reference ink droplet mark row or the ink droplet mark row being formed before a carrying action of the medium, and the other being formed after the carrying action; when the positions of the ink droplet marks are to be adjusted for performing printing on the medium by ejecting ink from the achromatic color ink ejecting section row, the timing for driving the other ink ejecting unit is adjusted according to ink droplet marks that are formed by the ink ejected from the achromatic color ink ejecting section row to make the reference ink droplet mark row and the ink droplet mark row that is formed by the other ink ejecting unit be continuous with each other; and when the positions of the ink droplet marks are to be adjusted for performing printing on the medium by ejecting inks from the chromatic color ink ejecting section rows, the timing for driving the other ink ejecting unit is adjusted to make a distance, in the predetermined direction, between the ink droplet mark rows, among the ink droplet mark rows formed by ejecting the inks from the chromatic color ink ejecting section rows, that are formed using magenta-type ink by a portion of the ink ejecting sections of the ink ejecting section row and a distance, in the predetermined direction, between the ink droplet mark rows, among the ink droplet mark rows formed by ejecting the inks from the chromatic color ink ejecting section rows, that are formed using cyan-type ink by a portion of the ink ejecting sections of the ink ejecting section row be approximately equal.

According to such a liquid ejecting apparatus, even when the moving member moves, for example, in different directions, the timing for each of a plurality of ink ejecting units is adjusted based on the timing of an ink ejecting unit that is stable in behavior during movement and that is positioned on a side, in a direction intersecting with the predetermined direction, that is close to a section, in the moving member, to which the external force is applied. Therefore, it is possible to reduce the variations in the positions of the ink droplet marks formed with each of the ink ejecting units for movement in both directions in which the ink ejecting units move. Further, it becomes possible to make adjustments on an ink ejecting unit basis, and therefore, adjustment can be controlled easily. Furthermore, since the medium is carried between the action of ejecting ink from the reference ink ejecting unit and the action of ejecting ink from the other ink ejecting unit, it is possible to make adjustments taking into account also the positional misalignment between ink droplet marks that occurs due to factors relating to medium-carrying precision.

Furthermore, it is possible to adjust the timing with substantially the same conditions as those for when actual printing is performed differently for when ink droplet marks are formed using achromatic color ink and for when ink droplet marks are formed using chromatic color ink(s), and particularly, magenta-type ink and cyan-type ink, so that the timing suits each case. As a result, it becomes possible to print texts, natural pictures, and so forth with higher quality.

It is also possible to achieve a method of adjusting positions of liquid droplet marks, comprising the steps of:

preparing a liquid ejecting apparatus including a moving member that has at least two liquid ejecting section groups and that is capable of moving in a predetermined direction due to an external force, each of the liquid ejecting section groups including at least two liquid ejecting sections for ejecting liquid droplets to form liquid droplet marks on a medium, each of the liquid ejecting section groups being driven based on a single reference ejection signal for causing the liquid droplets to be ejected from the liquid ejecting sections;

ejecting liquid to form a liquid droplet mark pattern including liquid droplet marks formed by ejecting liquid from the liquid ejecting sections of a reference liquid ejecting section group, among the liquid ejecting section groups, that is driven according to the reference ejection signal therefor at a predetermined reference timing and that is a liquid ejecting section group other than the liquid ejecting section group, among the liquid ejecting section groups, that is the most susceptible to vibration caused by moving the moving member and liquid droplet marks formed by ejecting liquid from the liquid ejecting sections of one other liquid ejecting section group, among the liquid ejecting section groups other than the reference liquid ejecting section group, that is driven according to the reference ejection signal therefor at a timing different from the predetermined reference timing; and adjusting the timing of the reference ejection signal for the one other liquid ejecting section group based on the liquid droplet mark pattern.

It is also possible to achieve a liquid ejecting system comprising:

a computer; and a liquid ejecting apparatus that is connected to the computer and that includes:

a moving member that has at least two liquid ejecting section groups and that is capable of moving in a predetermined direction due to an external force, each of the liquid ejecting section groups including at least two liquid ejecting sections for ejecting liquid droplets to form liquid droplet marks on a medium, and each of the liquid ejecting section groups being driven based on a single reference ejection signal for causing the liquid droplets to be ejected from the liquid ejecting sections;

a reference liquid ejecting section group, among the liquid ejecting section groups, that is driven according to the reference ejection signal therefor at a predetermined reference timing and that is a liquid ejecting section group other than the liquid ejecting section group, among the liquid ejecting section groups, that is the most susceptible to vibration caused by moving the moving member; and at least one other liquid ejecting section group, among the liquid ejecting section groups, that is driven according to the reference ejection signal therefor at a timing adjusted based on the predetermined reference timing of the reference liquid ejecting section group.

First Embodiment

Example of an Overview of a Printing Apparatus

Figure 2:
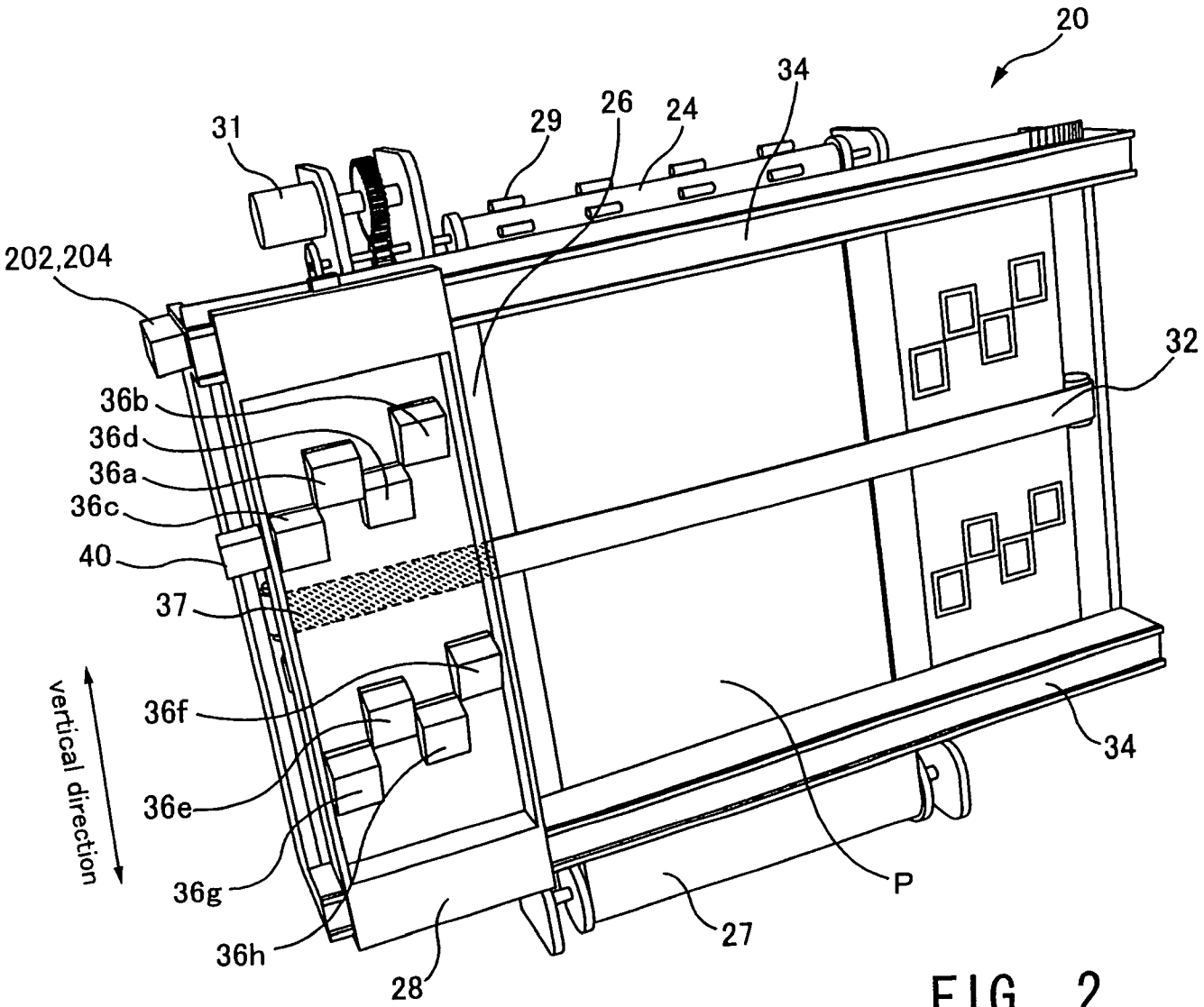
FIG. 2 is a perspective view showing an overview of the color inkjet printer 20, in which the position of a carriage 28 is different from FIG. 1, according to an embodiment of the present invention.

FIG. 1 and FIG. 2 are perspective views showing an overview of a color inkjet printer 20 serving as an example of the printing apparatus. The color printer 20 uses, for example, roll paper or relatively large-sized print paper such as JIS standard A0 sized paper or B0 sized paper, and in the example shown in FIG. 1 and FIG. 2, the color printer 20 is provided with roll paper. It should be noted that the position of the carriage, which is discussed later, is different in the color inkjet printer 20 shown in FIG. 1 and the color inkjet printer 20 shown in FIG. 2.

The color inkjet printer 20 shown in FIG. 1 and FIG. 2 is provided with a paper feed motor 31, a paper feed roller 24 (also called a "smap roller") as an example of the feed mechanism that is driven by the paper feed motor 31 and that is for feeding roll paper P, which is an example of the medium to be printed, in the paper feed direction (hereinafter, this is also called the sub-scanning direction), a roll paper holder 27 on which the roll paper P can be set, paper press rollers 29 for pressing the roll paper P against the paper feed roller 24, a platen 26 serving as an example of the support member that is capable of supporting the roll paper P, print heads 36 each provided with numerous nozzles, a carriage 28 serving as an example of the moving member that is provided with the print heads 36 and that can be moved in the main-scanning direction, a carriage motor 30, a pull belt 32 serving as an example of the drive member that is moved by the carriage motor 30, that is connected to the carriage 28 at a predetermined connecting section 37, and that is for driving the carriage 28, a guide rail 34 for guiding the carriage 28, a CCD camera 40 provided in/on the carriage 28 for capturing an image of the dots formed on the roll paper P by the ink that is ejected from the print heads 36, a temperature gauge 202 for measuring the temperature around the color inkjet printer 20, and a humidity gauge 204 for measuring the humidity around the color ink-jet printer 20.

The roll paper P is set in the roll paper holder 27. The roll paper P is pressed against the paper feed roller 24 by the paper press rollers 29, and is fed in the paper feed direction over the surface of the platen 26 by rotation of the paper feed roller 24. The carriage 28 is driven by the pull belt 32 and moved in the main-scanning direction along the guide rail 34. Then, as the roll paper P is fed in the paper feed direction, the carriage 28 is moved in the main-scanning direction and ink is ejected from the plurality of print heads 36 provided in/on the carriage 28 to carry out printing.

Figure 3:
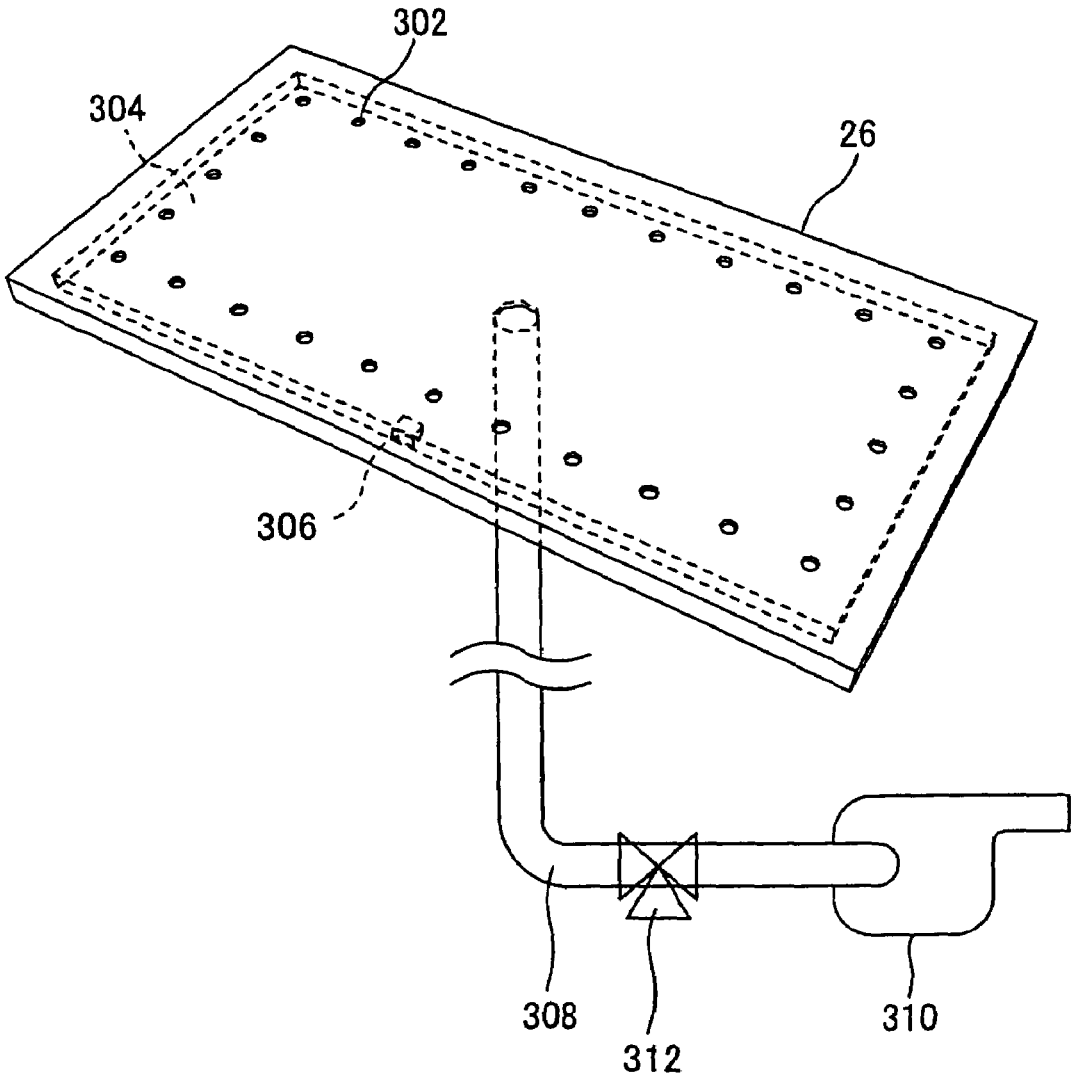
FIG. 3 is a conceptual diagram illustrating a platen 26 and a suction mechanism 16 according to an embodiment of the present invention.

Also, the platen 26, as shown in FIG. 3, has numerous suction apertures 302 in its upper surface, and is internally provided with a chamber 304 that is continuous with the suction apertures 302. FIG. 3 is a conceptual diagram illustrating the platen 26 and a suction mechanism 16, which is discussed later. The numerous suction apertures 302 are provided annularly along rim of the upper surface of the platen 26, and are in communication with the suction mechanism 16, which is an example of the suction member, via the chamber 304. The chamber 304 includes inside a pressure sensor 306, which is an example of the detector, for detecting the pressure inside the chamber 304.

The suction mechanism 16 has a suction blower 310 for sucking in the air within the chamber 304 to cause negative pressure therein and make the chamber 304 a vacuum, a hose 308 connecting the suction blower 310 and the chamber 304, and a switch valve 312 provided in the hose 308 between the suction blower 310 and the chamber 304. The switch valve 312 is constituted by an electromagnetic three-way valve that has an air release opening.

When the suction blower 310 is driven, the pressure within the chamber 304 drops, and the roll paper P supported by the platen 26 is sucked via the numerous suction apertures 302. Also, by switching the switch valve 312 in this state, atmospheric air can be released into the chamber 304.

That is, by controlling the suction blower 310 and the switch valve 312, an appropriate pressure can be established within the chamber so as to suck the roll paper P. Thus, the roll paper P can be kept flat without any bending occurring in the roll paper P.

It should be noted that in the above description, the numerous suction apertures 302 were provided annularly along the rim in the upper surface of the platen 26; however, they may also be provided at an equal spacing, for example, over the entire surface of the platen 26. This would allow the roll paper P to be adequately adhered, and has the benefit that cockling, for example, is less likely to occur.

Configuration of the Print Heads

Figure 4:
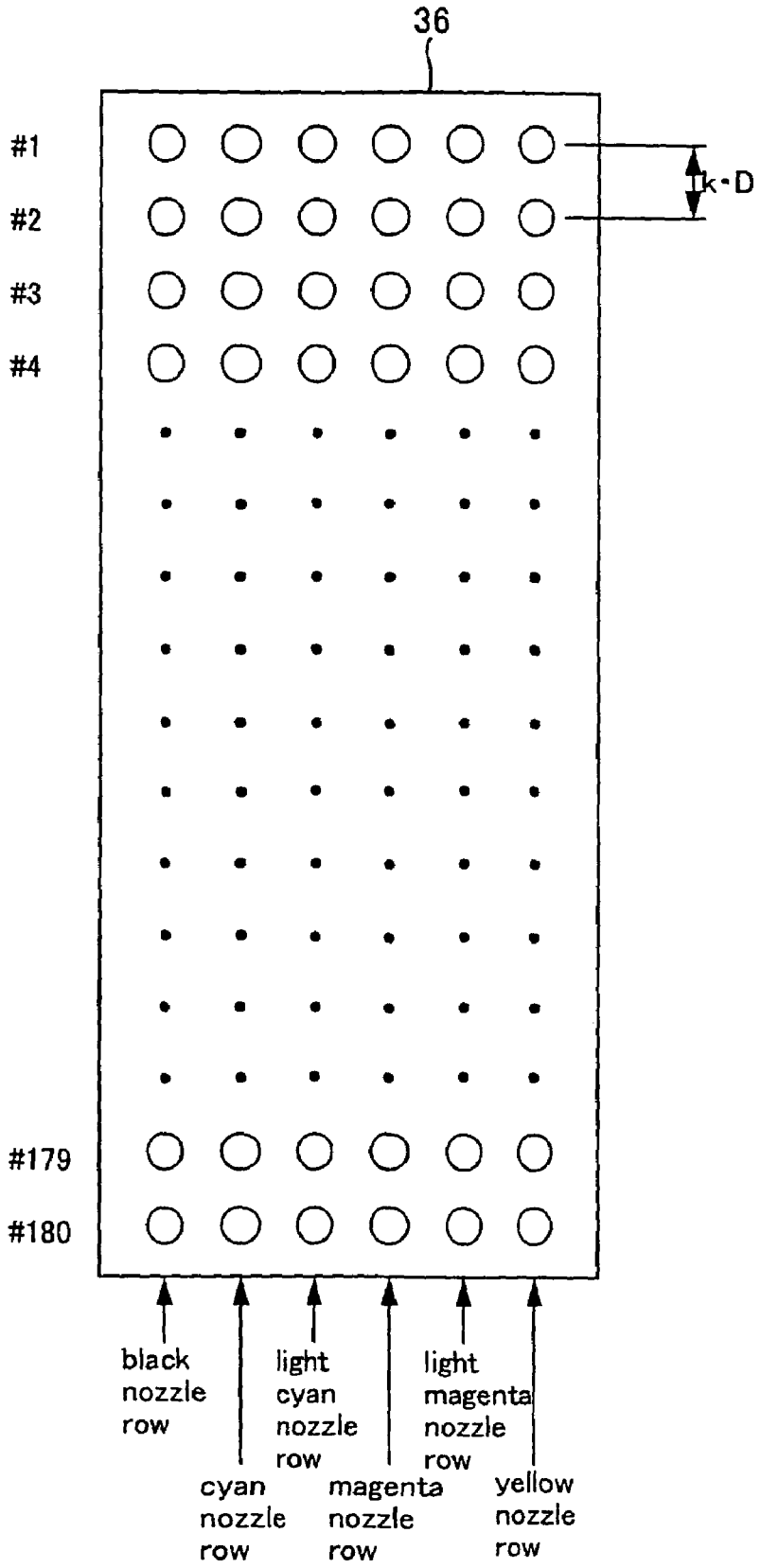
FIG. 4 is an explanatory diagram for describing print heads 36 according to an embodiment of the present invention.

Next, FIG. 4 is used to describe the configuration of the print heads 36. FIG. 4 is an explanatory diagram for describing the print heads 36.

The print head 36, as shown in FIG. 4, has a black nozzle row, a cyan nozzle row, a light cyan nozzle row, a magenta nozzle row, a light magenta nozzle row, and a yellow nozzle row, arranged in straight lines in the paper feed direction.

The black nozzle row has 180 nozzles, nozzles #1 to #180. The nozzles #1, . . . , #180 of the black nozzle row are arranged at a constant nozzle pitch k·D in the sub-scanning direction. Here, D is the dot pitch in the sub-scanning direction, and k is an integer. The dot pitch D in the sub-scanning direction is equal to the pitch of the main scan lines (raster lines), which are lines formed in the main scanning direction by dots. Hereinafter, the integer k expressing the nozzle pitch k·D is referred to simply as the "nozzle pitch k." In the example of FIG. 4, the nozzle pitch k is four dots. The nozzle pitch k, however, may be set to any integer.

The above-described matters also apply for the cyan nozzle row, the light cyan nozzle row, the magenta nozzle row, the light magenta nozzle row, and the yellow nozzle row. That is, each of these nozzle rows has 180 nozzles #1 to #180 arranged at a constant nozzle pitch k·D in the sub-scanning direction.

During printing, droplets of ink are ejected from the nozzles as the print heads 36 are moved at a constant speed in the main-scanning direction along with the carriage 28. However, depending on the print mode, there are instances in which only some of the nozzles are used and not all the nozzles are used.

It should be noted that in FIG. 4, the ink colors of the rows were, in order from the left side in the figure, the black nozzle row, the cyan nozzle row, the light cyan nozzle row, the magenta nozzle row, the light magenta nozzle row, and the yellow nozzle row; however, this is not a limitation, and it is also possible for the ink colors of the rows to be arranged in a different order.

Example of the Overall Configuration of the Printing System

Figure 5:
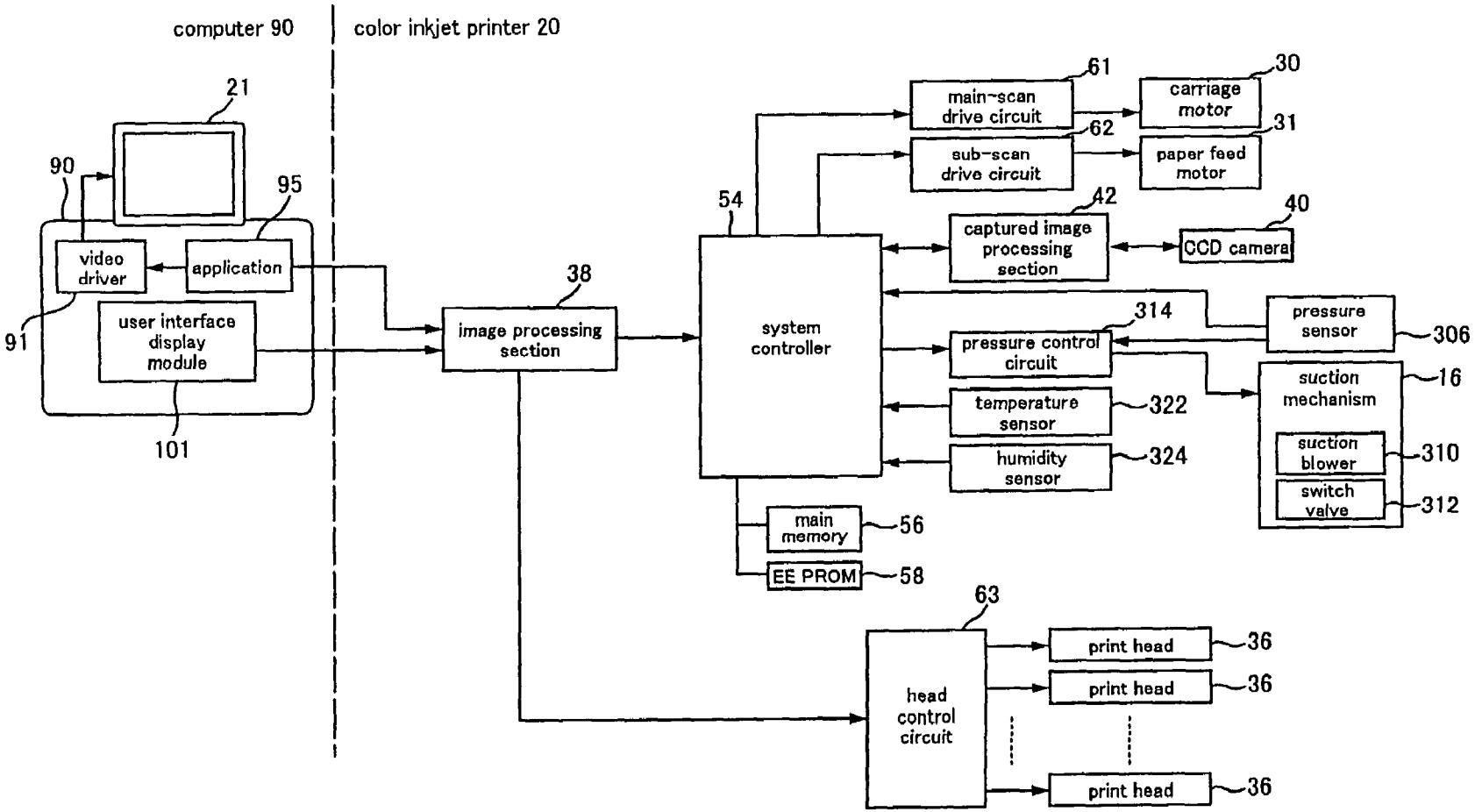
FIG. 5 is a block diagram showing the configuration of a printing system provided with the color inkjet printer 20 according to an embodiment of the present invention.
Figure 6:
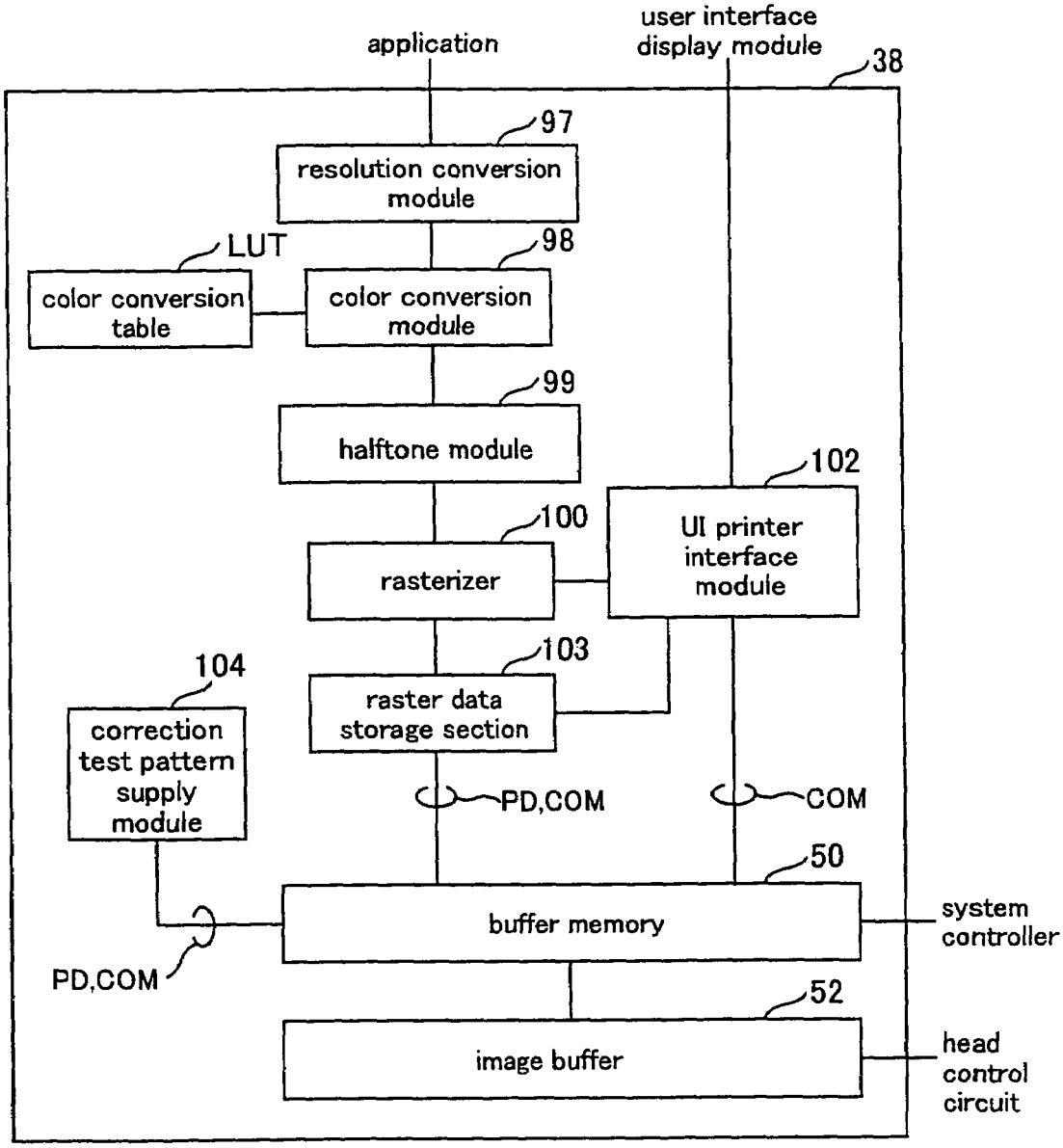
FIG. 6 is a block diagram showing the configuration of an image processing section 38 according to an embodiment of the present invention.

Next, an example of the overall configuration of the printing system is described with reference to FIG. 5 and FIG. 6. FIG. 5 is a block diagram showing the configuration of a printing system provided with the color inkjet printer 20 described above. FIG. 6 is a block diagram showing the configuration of an image processing section 38.

The printing system is provided with a computer 90 and the color inkjet printer 20, which is an example of the printing apparatus. It should be noted that the printing system including the color inkjet printer 20 and the computer 90 can also be broadly referred to as a "printing apparatus." Although not shown in the diagram, a printing system is made of the computer 90, the color inkjet printer 20, a display device such as a CRT 21 or a liquid crystal display device, input devices such as a keyboard and a mouse, and a drive device such as a flexible disk drive device or a CD-ROM drive device.

In the computer 90, an application program 95 is executed under a predetermined operating system. The operating system includes a video driver 91, and the application program 95, which is for retouching images, for example, carries out desired processing with respect to an image to be processed, and also displays the image on the CRT 21 through the video driver 91.

When the application program 95 issues a print command, the image processing section 38 provided in the color inkjet printer 20 receives image data from the application program 95 and converts the data into print data PD. As shown in FIG. 6, the image processing section 38 is internally provided with a resolution conversion module 97, a color conversion module 98, a halftone module 99, a rasterizer 100, a UI printer interface module 102, a raster data storage section 103, a color conversion lookup table LUT, a correction test pattern supply module 104, a buffer memory 50, and an image buffer 52.

The resolution conversion module 97 serves to convert the resolution of the color image data generated by the application program 95 into the print resolution. The image data whose resolution has been thus converted at this point is still image information made of the three color components RGB. The color conversion module 98 references the color conversion look-up table LUT and, for each pixel, converts the RGB image data into multi-gradation data of a plurality of ink colors that can be used by the color inkjet printer 20.

The multi-gradation data that has been color converted has a gradation value of 256 grades, for example. The halftone module 99 executes so-called halftone processing to generate halftone image data. The halftone image data are arranged by the rasterizer 100 into a desired data order, and are output as the final print data PD to the raster data storage portion 103 along with various commands COM.

Also, the correction test pattern supply module 104 has a function for outputting, to the buffer memory 50, print data PD used when executing the operation for forming, on the roll paper P, dots for correcting the feed amount by which the paper feed roller 24 feeds the roll paper P. These print data PD include raster data indicating how the dots are to be formed during each main scan and data indicating the sub-scanning feed amount.

On the other hand, the user interface display module 101 provided in the computer 90 functions to display various types of user interface windows related to printing and also functions to receive inputs from the user through these windows. For example, a user could instruct the type and size of the print paper, or the dot recording mode, for example, through the user interface display module 101.

The UI printer interface module 102 functions as an interface between the user interface display module 101 and the color inkjet printer 20. The UI printer interface module 102 interprets instructions given by the user through the user interface and sends various commands COM to the buffer memory 50, for example, or conversely, it interprets commands COM received from the buffer memory 50, for example, and executes various displays on the user interface. For example, the above-mentioned instruction regarding the type or the size of the print paper, for example, that is received by the user interface display module 101 is sent to the UI printer interface module 102, which interprets this instruction and sends a command COM to the buffer memory 50.

The UI printer interface module 102 also functions as a print mode setting section. That is, the UI printer interface module 102 determines the print mode based on information on the dot recording mode received by the user interface display module 101 and the information of the print data PD output from the rasterizer 100.

More specifically, a high image quality mode and a fast mode are provided as the dot recording modes, and the user can select either one of these modes. For example, the high image quality mode is a mode in which dots are recorded using a so-called overlapping method, and fast mode is a mode in which dots are recorded without using this method. Then, the UI printer interface module 102 determines the print mode based on the dot recording mode that has been selected and the resolution information found in the print data PD. Next, according to the print mode that has been determined, the UI printer interface module 102 outputs, to the raster data storage section 103, information about the nozzles to be use when printing and information about the data indicating the sub-scanning feed amount.

The raster data storage section 103 outputs the final print data PD to the buffer memory 50 together with various commands COM. The print data PD includes raster data indicating how dots are to be formed in each main scan, information about the nozzles to be used when printing, and the data indicating the sub-scanning feed amount.

The print data PD and the various commands COM that are output by the raster data storage section 103 and the correction test pattern supply module 104, and the commands COM output by the UI printer interface module 102, are temporarily stored in the buffer memory 50. After the color inkjet printer 20 receives these at the buffer memory 50, it transmits them to the image buffer 52 or the system controller 54. The print data PD for the plurality of colors that have been received by the buffer memory 50 are stored in the image buffer 52.

The color inkjet printer 20 is provided with a system controller 54 for controlling the overall operation of the color inkjet printer 20, a main memory 56, and an EEPROM 58, in addition to the image processing section 38 described above. The system controller 54 is connected to a main-scan drive circuit 61 for driving the carriage motor 30, a sub-scan drive circuit 62 for driving the paper feed motor 31, a head control circuit 63 for controlling the print heads 36, a captured image processing section 42 for processing images captured by the above-described CCD camera 40, the above-described pressure sensor 306, a pressure control circuit 314 for controlling the suction mechanism 16 described above according to the output value of the pressure sensor 306, the temperature sensor 322 described above, and the humidity sensor 324 described above.

In the color inkjet printer 20, the system controller 54 reads necessary information from the print data in the buffer memory 50, and based on this information, sends control signals to the main-scan drive circuit 61, the sub-scan drive circuit 62, and the head control circuit 63, for example. Also, the head control circuit 63 reads print data for the various color components from the image buffer 52 in accordance with the control signal from the system controller 54, and based on the print data, drives the nozzles for the various color provided in the print heads 36.

The system controller 54 also controls the suction blower 310 and the switch valve 312 according to the output value of the pressure sensor 306 using the pressure control circuit 314. Accordingly, the inside of the chamber is kept at a desired pressure, and suitable suction of the roll paper P can be achieved.

Operation of the Printing System

Figure 7:
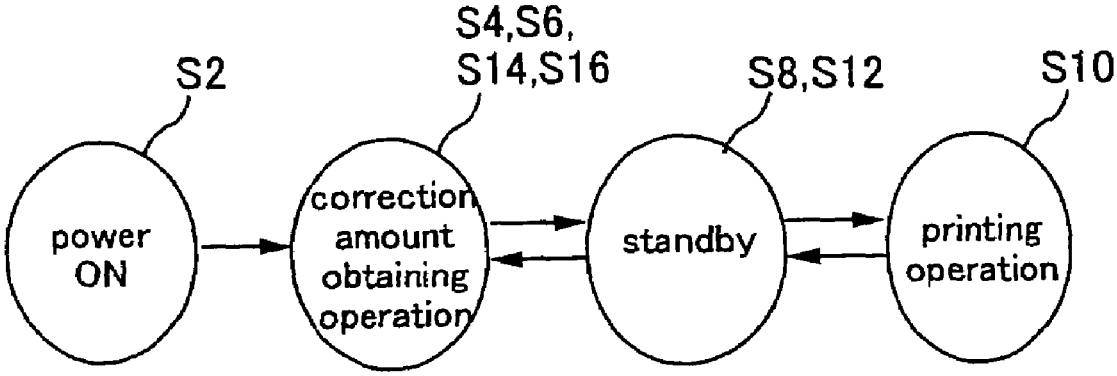
FIG. 7 is a transition diagram showing the operation of the printing system according to an embodiment of the present invention.

The operation of the above-described printing system is described next using FIG. 7. FIG. 7 is a transition diagram showing the operation of the printing system.

First, the user turns the power of the computer 90 and the power of the color inkjet printer 200N in order to supply power to the printing system (step S2).

After power has been supplied to the printing system and before an image is printed to the roll paper P, the color ink-jet printer 20 carries out an operation for forming, on the roll paper P, dots for correcting the feed amount by which the paper feed roller 24 feeds the roll paper P (step S4). Then, based on the correction test pattern, which is a group of the dots thus formed on the roll paper P, the color inkjet printer 20 executes an operation for obtaining a correction amount for correcting the feed amount by which the roll paper P is fed (step S6). Hereinafter, these operations according to step S4 and step S6 may also be collectively referred to as the "correction amount obtaining operation".

Figure 8:
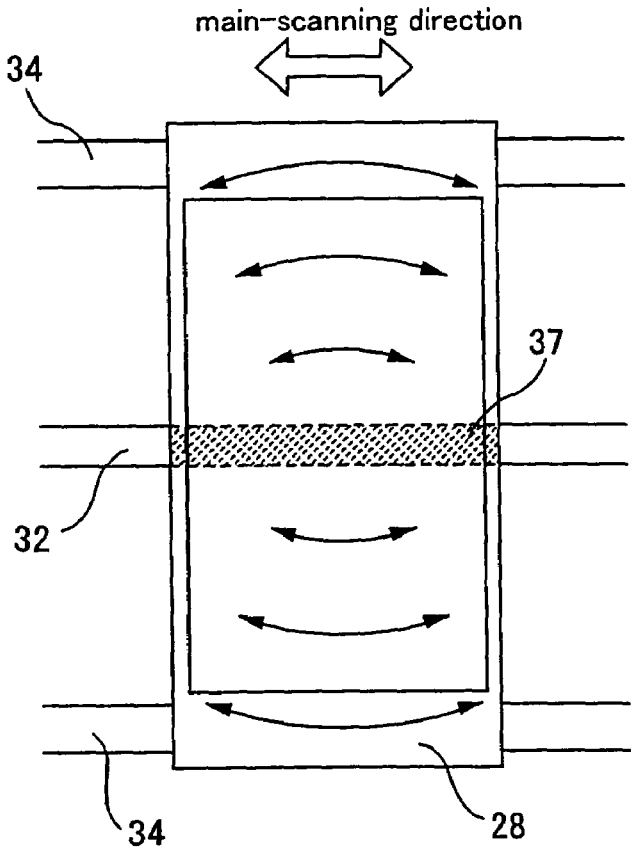
FIG. 8 is a conceptual diagram illustrating how vibration occurs when a carriage 28 is moved according to an embodiment of the present invention.
Figure 9:
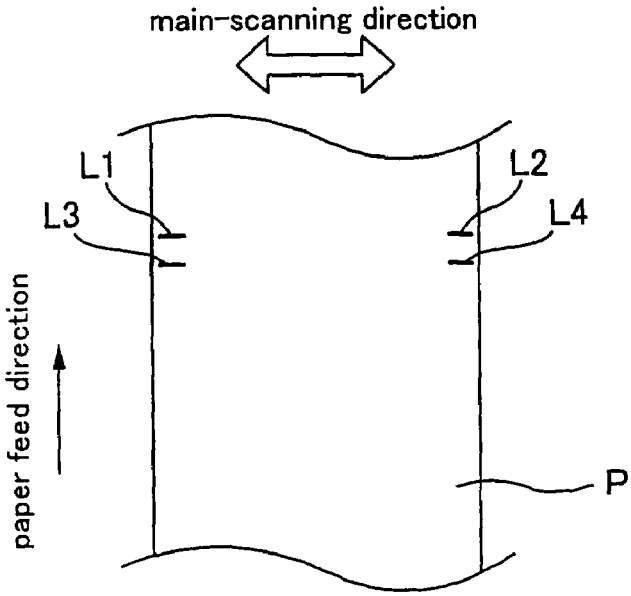
FIG. 9 is a conceptual diagram showing an example of a correction test pattern according to an embodiment of the present invention.

The operation of step S4 will be described using FIG. 8 and FIG. 9. FIG. 8 is a conceptual diagram illustrating how the vibration is generated when the carriage 28 is moved. FIG. 9 is a conceptual diagram showing an example of a correction test pattern.

First, the color injection printer 20 receives the above-mentioned command to turn on the power source, and print data PD about the correction test pattern is sent from the correction test pattern supply module 104 to the buffer memory 50 together with various commands COM. The image processing section 38 sends the print data PD to the image buffer 52 after receiving the data at the buffer memory 50.

The image processing section 38 also sends the above-described commands COM to the system controller 54 after they are received by the buffer memory 50. The system controller 54 then sends control signals to the main-scan drive circuit 61, the sub-scan drive circuit 62, and the head control circuit 63 based on the information received from the buffer memory 50 within the image processing section 38.

The head control circuit 63 reads the print data PD from the image buffer 52 within the image processing section 38 according to the control signals from the system controller 54. The head control circuit 63 then controls the print heads 36 based on the data that has been read out.

Then, while the sub-scan drive circuit 62 controls the paper feed motor 31 so that it feeds the roll paper P, the carriage motor 30 is controlled by the main-scan drive circuit 61 to move the carriage 28 in the main-scanning direction and the print heads 36 are controlled by the head control circuit 63 to eject ink, thereby forming, on the roll paper P, dots for correcting the feed amount by which the roll paper P is fed.

It should be noted that at this time, a print head 36, among the plurality of print heads 36 provided in/on the color ink-jet printer 20, that is the least susceptible to the vibration caused by moving the carriage 28 is used as the print head 36 that is used when forming these dots onto the roll paper P.

In the present embodiment, this print head is the print head that is closest to the connecting section 37 between the carriage 28 and the pull belt 32. This is described using FIG. 8.

In FIG. 8, the carriage 28 is guided along the guide rail 34 and moved in the main-scanning direction (in the diagram, the direction shown by the white arrow). At this time, vibration occurs in the carriage 28 in the direction shown by the black arrows in the diagram. Also, since the carriage 28 is driven by the pull belt 32, the vibration becomes larger as the distance from the connecting section 37 becomes greater in the direction perpendicular to the main-scanning direction, as shown in the diagram.

Consequently, in this example, as shown in FIG. 1 and FIG. 2, the print head 36*c* is the print head that matches these conditions, and ink is ejected from the print head 36*c* to form, on the roll paper P, dots for correcting the feed amount by which the roll paper P is fed. It should be noted that the print heads 36 have not been shown in FIG. 8 in order to make the diagram easy to understand.

As described above, the color inkjet printer 20 feeds the roll paper P while moving the carriage 28 in the main-scanning direction and ejecting ink from a print head 36 to form, on the roll paper P, dots for correcting the feed amount by which the roll paper P is fed. The group of dots formed on the roll paper P then functions as a test pattern for correction. FIG. 9 shows an example of the dots that are formed. In FIG. 9, four transverse lines L1, L2, L3, and L4 are shown as the correction test pattern at the both edges of the roll paper P, and these are made of groups of dots lined up in the main-scanning direction.

The procedure through which these transverse lines L1, L2, L3, and L4 are formed is described next. First, the carriage 28 is moved in the main-scanning direction as ink is ejected from predetermined nozzles of the print head 36 to form the transverse line L1. Then, when the carriage 28 has arrived at a predetermined position, the ejection of ink is temporarily stopped. With the ejection of ink stopped, the carriage 28 is moved further in the main-scanning direction, and when the carriage 28 has arrived at a predetermined position, ink ejection starts again, and the transverse line L2 is formed.

After the transverse line L2 has been formed, the roll paper P is fed in the paper feed direction by a feed amount y. Then, while the carriage 28 is being moved in the main-scanning direction, ink is ejected from the nozzles used to form the transverse lines L1 and L2, forming the transverse line L3. Then, when the carriage 28 has reached a predetermined position, the ejection of ink is temporarily stopped. With ink ejection stopped, the carriage 28 is carried further in the main-scanning direction, and when the carriage 28 has reached a predetermined position, the ejection of ink is started again. Then, the transverse line L4 is formed.

Next, based on the correction test pattern formed on the roll paper P, the color inkjet printer 20 carries out an operation for obtaining a correction amount for correcting the feed amount by which the paper feed roller 24 feeds the roll paper P. (step S6).

This operation is described below. First, the color ink-jet printer 20 moves the carriage 28 in the main-scanning direction and positions the carriage 28 in a position where both the transverse line L1 and the transverse line L3 can be captured by the CCD camera 40. Then, both the transverse line L1 and the transverse line L3 are captured by the CCD camera 40. Next, the color inkjet printer 20 moves the carriage 28 in the main-scanning direction and positions it in a position where the CCD camera 40 can capture both the transverse line L2 and the transverse line L4, and an image of both the transverse line L2 and the transverse line L4 is captured.

The two images captured in this way are sent to the captured image processing section 42, and both images undergo image processing. Then, from the result of this image processing, the distance between the transverse line L1 and the transverse line L3 is obtained as a feed amount Y1, and the distance between the transverse line L2 and the transverse line L4 is obtained as a feed amount Y2.

The information on the feed amount Y1 and the feed amount Y2 that have been obtained is sent to the system controller 54. The system controller 54 then calculates the average value Y of Y1 and Y2, and subtracts the above-mentioned feed amount y from the average value Y, obtaining a correction amount C (C=Y−y) for correcting the feed amount by which the paper feed roller 24 feeds the roll paper P. Then, this correction amount is set in the EEPROM 58 of the color inkjet printer 20.

It should be noted that in parallel with the above correction amount obtaining operation, or before or after this operation, the system controller 54 obtains data on the pressure inside the chamber 304 and the temperature and the humidity around the color inkjet printer 20 from the pressure sensor 306, the temperature sensor 322, and the humidity sensor 324, respectively. The data obtained are set in the EEPROM 58 of the color inkjet printer 20 together with the correction amount.

After the correction amount obtaining operation of step S4 and step S6 is over, the color inkjet printer 20 enters a standby state (step S8). In this embodiment, this standby state is a state in which the power is on and the correction amount obtaining operation or the printing operation is not being performed.

Then, in the standby state, the system controller 54 constantly obtains data on the on the pressure inside the chamber 304 and the temperature and the humidity around the color ink-jet printer 20 from the pressure sensor 306, the temperature sensor 322, and the humidity sensor 324, respectively. These data that are obtained are compared with the data on the pressure, temperature, and humidity already stored in the EEPROM 58, and the differences between them is obtained. Then, if even one of the obtained difference in pressure, the obtained difference in temperature, and the obtained difference in humidity, exceeds a threshold value that has been respectively determined in advance, then the color inkjet printer 20 carries out the correction amount obtaining operation described above.

It should be noted that below, the description is continued under the premise that the correction amount obtaining operation is not performed in step S8.

Next, when an instruction to perform printing is made by the user in the application program 95, for example, the color inkjet printer 20 carries out the printing operation (step S10). The printing operation is described below.

Having received an instruction to perform printing, the application program 95 issues a print command. Then, the image processing section 38 mentioned above receives image data from the application program 95 and converts the data into print data PD, and the print data PD, together with various commands COMPUTER 90, are transmitted to the buffer memory 50. The image processing section 38 receives the print data PD through the buffer memory 50, and then sends the print data PD to the image buffer 52.

The image processing section 38 also receives the above commands COM through the buffer memory 50 and then sends them to the system controller 54. Based on the information received from the buffer memory 50 in the image processing section 38, the system controller 54 sends control signals to the main-scan drive circuit 61, the sub-scan drive circuit 62, and the head control circuit 63.

Also, the head control circuit 63 reads the print data for each of the various color components from the image buffer 52 in the image processing section 38 in accordance with the control signal from the system controller 54. Then, the head control circuit 63 controls the plurality of print heads 36*a*, 36*b*, 36*c*, 36*d*, 36*e*, 36*f*, 36*g*, and 36*h* according to the data that have been read out.

Then, while the sub-scan drive circuit 62 controls the paper feed motor 31 to feed the roll paper P, the main-scan drive circuit 61 controls the carriage motor 30 to move the carriage 28 in the main-scanning direction, and the head control circuit 63 controls the plurality of print heads 36*a*, 36*b*, 36*c*, 36*d*, 36*e*, 36*f*, 36*g*, and 36*h* to make them eject ink and print on the roll paper P. It should be noted that at this time, the operation of the paper feed motor 31 is corrected based on the correction amount that is stored in the EEPROM 58, that is, that has been set in the EEPROM 58 at step S6.

When the printing operation of the color inkjet printer 20 is over, the color inkjet printer 20 enters the standby state (step S12).

Then, as mentioned above, in the standby state, the system controller 54 constantly obtains data about the pressure within the chamber 304 and the temperature and the humidity around the color inkjet printer 20 from the pressure sensor 306, the temperature sensor 322, and the humidity sensor 324, respectively. These data that are obtained are compared with the data about the pressure, temperature, and humidity already stored in the EEPROM 58, and any difference between them is found. If even one of the obtained difference in pressure, the obtained difference in temperature, and the obtained difference in humidity, exceeds a threshold value that has been respectively determined in advance, then the color inkjet printer 20 carries out the correction amount obtaining operation described above.

It should be noted that in this embodiment, in step S12, the operation state of the printer has changed to the correction amount obtaining operation as a result of the type of the print paper being changed. A detailed description of this is as follows.

The user, in the standby state of step S12, changes the type of the print paper through the user interface display module 101. These instructions received through the user interface display module 101 are sent to the UI printer interface module 102 provided in the image processing section 38, and the UI printer interface module 102 interprets the order that has been instructed and sends a command COM to the buffer memory 50. The image processing section 38 receives this command COM and subsequently transmits it to the system controller 54.

The system controller 54 determines that the print paper type has been changed, and from the standpoint that the roll paper P is to be kept in a flat state, the controller 54 sets, to the pressure sensor control circuit 314, a value for the pressure within the chamber 304 that is adequate for the new type of print paper. Then, the pressure sensor control circuit 314 controls the suction mechanism 16 so that the pressure within the chamber 304 becomes the pressure value that has been set.

As a result of this control, the output value of the pressure sensor changes, and if that change is large, then the color ink-jet printer 20 starts executing the correction amount obtaining operation. Then, in the correction amount obtaining operation, the same operations as those described in step S4 and step S6 are executed (step S14 and step S16), and a new correction amount is set in the EEPROM 58. The new correction amount that has been set is used for controlling the operation of the paper feed motor 31 in the printing operation that is performed next.

In this manner, ink is ejected from the print head, among the plurality of print heads, that is the least susceptible to the vibration generated when the carriage is moved, to form, on the roll paper, dots for correcting the feed amount by which the roll paper is fed by the paper feed roller as the carriage is moved, thereby allowing the feed amount to be suitably corrected.

That is, as described in the Description of the Related Art, when dots for correcting the feed amount are formed on the roll paper as the carriage is moved, vibration occurs in the carriage. Since the print heads are provided on the carriage, that vibration is also transmitted to the print heads.

Under these circumstances, when dots for correcting the feed amount are formed on the print paper by ejected ink from the print heads, a desired correction test pattern cannot be obtained, and consequently, there is a possibility that the correction amount obtained based on this correction test pattern will be inaccurate. Thus, when the feed amount is corrected based on this correction amount, appropriate correction can no longer be executed.

Accordingly, as above, ink is ejected from the print head of the plurality of print heads that is the least susceptible to the vibration generated when the carriage is moved, to form, on the roll paper, dots for correcting the feed amount by which the roll paper is fed by the paper feed roller as the carriage is moved.

Thus, if ink is ejected from the print head that is the least susceptible to the vibration, which is caused by moving the carriage, to form, on the print paper, dots for correcting the feed amount, then since the vibration has less of an impact, a desired correction test pattern is obtained, and consequently, the correction amount that is obtained based on that correction test pattern becomes accurate. Then, when the feed amount is corrected based on this correction amount, adequate correction of the feed amount can be implemented.

It should be noted that in the above discussion, the number of print heads was set to eight; however, this is not a limitation, and as long as the number is plural, there may be any number of print heads.

Also, in the above description, the correction test pattern formed on the roll paper was captured with the CCD camera and image processing was carried out in order to obtain a suitable correction amount; however, this is not a limitation, and for example, it is also possible to form a plurality of correction test patterns on the roll paper and for the user to select from these patterns a suitable correction test pattern so as to obtain a suitable correction amount.

Also, in the above description, a correction test pattern was formed on the roll paper by ejecting ink from a print head, and after finishing this process, that correction test pattern was captured by the CCD camera. This is not a limitation, however, and it is for example also possible to form a correction test pattern on the roll paper by ejecting ink from a print head while the CCD camera, which is adjacent to that print head, captures an image of the correction test pattern.

Also, in the above description, the image processing section shown in FIG. 6 was used as an example of a image processing means; however, this is not a limitation, and any means may be adopted, as long as it processes images output by an application, for example, in order to carry out operations such as to send print data to the head control circuit. For example, it is not necessary for the color conversion table to always be referenced when the color conversion module performs color conversion, and it is also not necessary for halftone processing to always be performed when image processing is carried out. It is also possible for the image processing means to not include a function as a user interface, such as the UI printer interface module.

Also, in the above description, the print mode was determined from the dot recording mode that was selected and the information on the resolution found in the print data PD. This is not a limitation, however. For example, it is also possible for the print mode to be determined based on only one of either the dot recording mode or the resolution. In the above description, a high image quality mode and a fast mode were described as the dot recording modes, but this is not a limitation.

Also, a correction test pattern that is made of a group of dots lined up in the main-scanning direction was shown in the above description, but it is also possible for the correction test pattern to be made of dots.

Other Considerations

An embodiment of a printing apparatus, for example, according to the present invention has been described above. However, the foregoing embodiment of the invention is for the purpose of elucidating the present invention and is not to be interpreted as limiting the present invention. The invention can of course be altered and improved without departing from the gist thereof and includes functional equivalents.

It should be noted that in the above embodiment, print paper was described as the medium to be printed, but as the medium to be printed it is also possible to use film, cloth, or thin metal plates, for example. Also, roll paper was described as an example of the print paper, but it is also possible to use A0 paper or B0 paper, for example, as the print paper.

Also, in the above embodiment a color inkjet printer was described, but the present invention is also applicable for monochrome inkjet printers as well.

Also, in the above embodiment, ink was ejected from the print head located the closest to the connecting section between the carriage and the pull belt while the carriage was moved so as to form, onto the roll paper, dots for correcting the feed amount by which the paper feed roller feeds the roll paper. However, this is not a limitation.

In this case, however, the print head that is the least susceptible to vibration can be easily selected from among the plurality of print heads, and in this regard the above-described embodiment is preferable.

Also, in the above embodiment, ink was ejected from a print head while the carriage was moved so as to form, on both edge sections of the roll paper, dots for correcting the feed amount. However, this is not a limitation, and for example, it is also possible for ink to be ejected from a print head while the carriage is moved so as to form dots for correcting the feed amount on only one edge section of the roll paper.

In the case of the above-mentioned embodiment, however, two groups of correction test patterns can be obtained, thereby allowing the correction amount to be obtained more accurately. Therefore, from the standpoint that more suitable correction can be carried out, the embodiment described above is more preferable.

Also, in the above embodiment, ink is ejected from predetermined nozzles provided in the predetermined print head to form dots for correcting the feed amount on the roll paper; however, this is not a limitation. For example, it is also possible to change the nozzles that eject ink every time dots for correcting the feed amount are formed on the roll paper.

However, from the standpoint that error due to changing the nozzles that eject ink does not occur, the configuration of the above-mentioned embodiment is preferable.

Also, in the above embodiment, whether or not to form, onto the roll paper, the dots for correcting the feed amount by which the print paper is fed by the paper feed roller was determined according to the output value of the pressure sensor. However, this is not a limitation.

When, however, the force by which the roll paper is sucked by the suction mechanism fluctuates, the friction of the roll paper against the platen also fluctuates, and therefore there is a higher possibility that the correction amount appropriate for correcting the feed amount will change.

Consequently, from the perspective that dots for correcting the feed amount by which the roll paper is fed by the paper feed roller are formed on the roll paper at an appropriate timing, the above-mentioned embodiment is preferable.

Also, in the above embodiment, whether or not to form the dots for correcting the feed amount, by which the paper feed roller feeds the roll paper, onto the roll paper was determined according to at least one of the temperature value and the humidity value around the color inkjet printer. However, this is not a limitation.

When, however, the temperature or the humidity around the color inkjet printer fluctuates, the roll paper will expand/constrict or the above-described friction may fluctuate, and therefore there is a high possibility that the correction amount appropriate for correcting the feed amount will change.

Consequently, from the perspective that dots for correcting the feed amount by which the roll paper is fed by the paper feed roller are formed on the roll paper at an appropriate timing, the above embodiment is preferable.

Also, in the above embodiment, the dots for correcting the feed amount by which the roll paper is fed by the paper feed roller are formed on the roll paper when power is supplied to the color inkjet printer. However, this is not a limitation. For example, it is also possible for dots for correcting the feed amount by which the roll paper is fed by the paper feed roller to not be formed on the roll paper when power is supplied to the color ink-jet printer.

However, from the standpoint that execution of appropriate correction can be guaranteed, the embodiment described above is preferable.

It is also possible for dots for correcting the feed amount by which the roll paper is fed by the paper feed roller to be formed on the print paper during the printing operation of the color inkjet printer.

For example, if those dots may be formed on the print paper when a new page is printed, or if a plurality of sheets of print paper are printed continuously, then it is possible for those dots to be formed on the print paper each time a predetermined number of sheets of the print paper have been printed.

Doing this allows the dots to be formed on the print paper efficiently.

It is also possible to form dots for correcting the feed amount, by which the roll paper is fed by the paper feed roller, onto the print paper when the print paper has been exchanged.

Doing this allows execution of suitable correction to be guaranteed.

It is also possible to provide the color inkjet printer with a detector (second detector) for detecting whether or not the print paper has been exchanged, and when it is detected by the detector that the print paper has been exchanged, the dots for correcting the feed amount by which the paper is fed by the paper feed roller may be formed on the print paper.

For example, a reflective-type optical sensor can be used as the detector, in which case the light that is emitted from the reflective-type optical sensor toward the print paper is reflected by the print paper and the intensity of that reflected light is measured in order to detect whether or not the print paper has been exchanged.

Accordingly, whether or not the print paper has been exchanged can be detected using a simple method.

It is also possible for the dots for correcting the feed amount by which the roll paper is fed by the paper feed roller to be formed on the print paper when the print mode, which was discussed above, of the color inkjet printer has been changed.

Since the paper feed amount is different for each print mode, this would ensure execution of appropriate correction.

Also, in the above embodiment, a plurality of correction amounts for correcting the feed amount by which the roll paper is fed by the paper feed roller were obtained based on the dots formed on the roll paper, and based on the average value of the plurality of correction amounts that were obtained, the feed amount by which the roll paper is fed by the paper feed roller was corrected. However, this is not a limitation. For example, it is also possible to obtain a single correction amount for correcting the feed amount by which the roll paper is fed by the paper feed roller based on the dots formed on the roll paper, and based on the correction amount that is obtained, the feed amount by which the roll paper is fed by the paper feed roller can be corrected.

However, from the perspective that more accurate correction can be carried out in the present case, the configuration of the above embodiment is preferable.

With the present invention, it is possible to achieve a printing apparatus with which correction of the feed amount can be suitably carried out.

Second Embodiment

Example of an Overview of a Printing Apparatus

Figure 10:
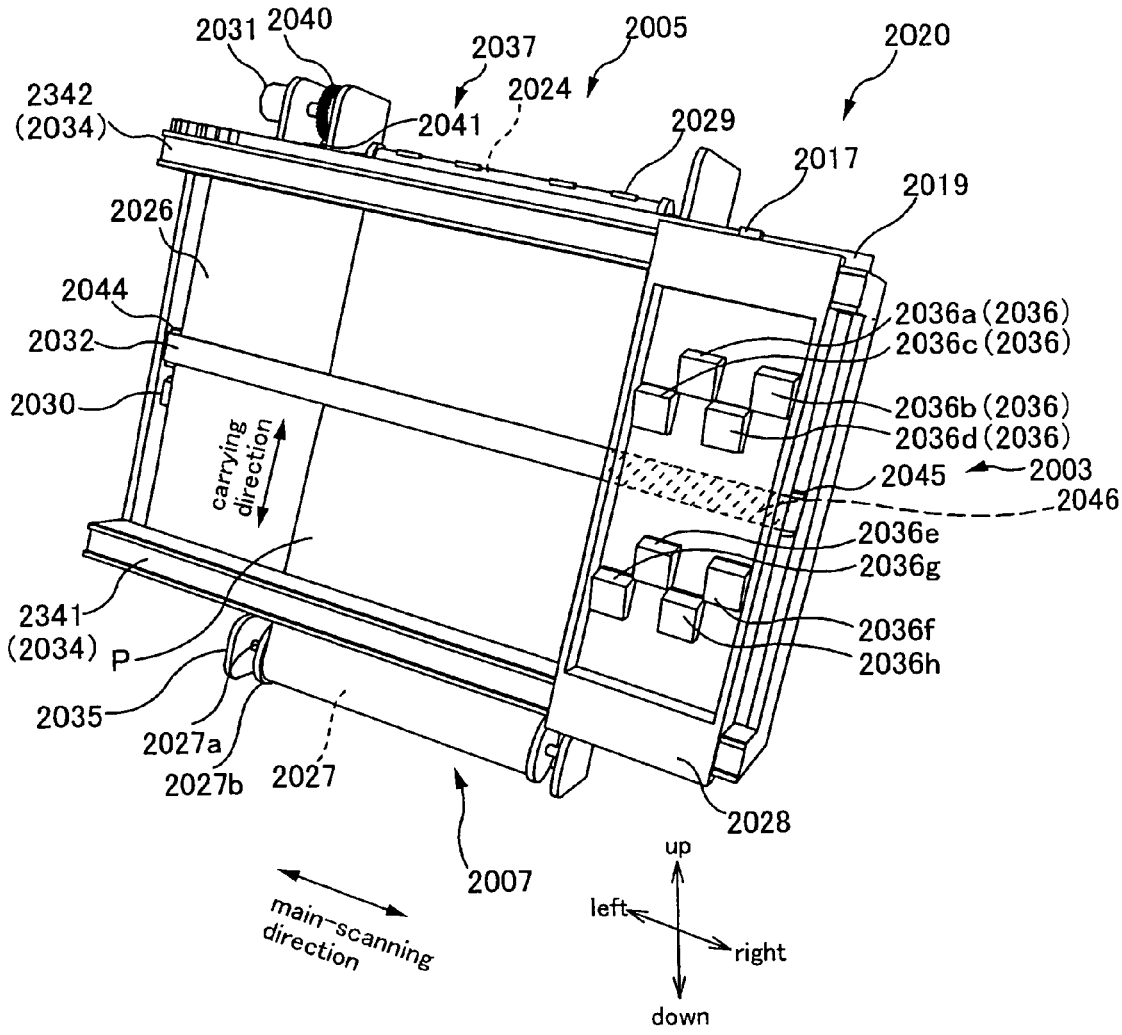
FIG. 10 is a perspective view showing an overview of a color printer according to a second embodiment of the present invention.
Figure 11:
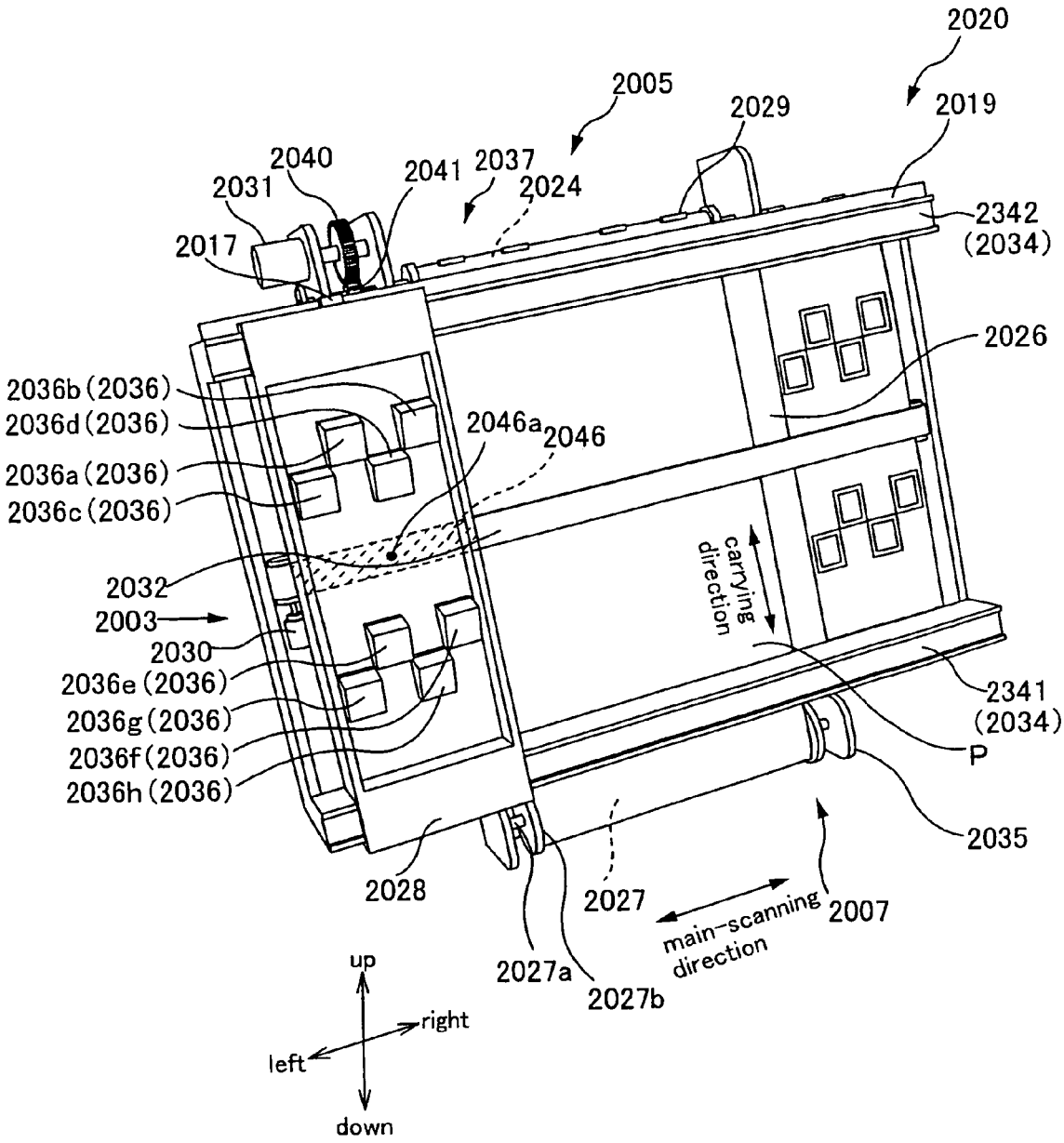
FIG. 11 is a perspective view showing the color printer in FIG. 10 in a state in which the carriage has been moved.

FIG. 10 and FIG. 11 are perspective views showing an overview of a color inkjet printer (referred to as "color printer" in the following) 2020, which serves as a liquid ejecting apparatus in which ink (as an example of liquid) is ejected from nozzles (as an example of liquid ejecting sections) to perform printing, according to a second embodiment of the present invention. This color printer 2020 is an inkjet printer that is capable of outputting color images and that prints images by forming dots by ejecting colored ink of, for example, the six colors—cyan-type ink such as cyan ink (C) and light cyan ink (pale cyan ink, LC), magenta-type ink such as magenta ink (M) and light magenta ink (pale magenta ink, LM), yellow ink (Y), and black ink (K)—on various kinds of media, such as print paper. It should be noted that the colored inks are not limited to the above-noted six colors, and it is also possible to use, for example, dark yellow (dim yellow, DY) or the like. The color printer 2020 is adapted, for example, to roll paper in which print paper serving as the medium to be printed is wound up in roll-shape, but also to relatively large single-sheet print paper, such as A0 or B0 size paper according to the JIS standard. In the example shown in FIG. 10 and FIG. 11, the color printer 2020 is provided with roll paper. In FIG. 10 and FIG. 11, the position of the carriage 2028 provided on the color printer 2020 is different. This carriage 2028 will be explained further below.

As shown in the figures, the color printer 2020 includes a printing section 2003 that ejects ink in order to print on the roll paper P, and a print paper carrying section 2005 for carrying the print paper.

The printing section 2003 includes a carriage 2028 which serves as a moving member, a carriage motor 2030, a pull belt 2032, two guide rails 2034, a linear encoder 2017, and a linear encoder code plate 2019. The carriage 2028 integrally holds print heads 2036 which serve as ink ejecting section groups, or ink ejecting units, provided with nozzles serving as a plurality of ink ejecting sections. The carriage motor 2030 is for causing the carriage 2028 to move (or scan) back and forth by moving it in a direction (which is referred to as "main-scanning direction" below) that is approximately perpendicular to the direction in which the roll paper P is carried (which is referred to as "sub-scanning direction" below). The pull belt 2032 is made of metal, configures a "moving member (moving means)" in cooperation with the carriage motor 2030, and is driven by the carriage motor 2030 to move the carriage 2028. The guide rails 2034 are for guiding the carriage 2028. The linear encoder 2017 is fixed to the carriage 2028, and the linear encoder code plate 2019 has slits formed therein at predetermined intervals.

The two guide rails 2034 are arranged at the top and the bottom along the main scanning direction with a certain spacing in the sub-scanning direction between them, and are supported at their left and right end sides by a frame (not shown) serving as a base. Of the two guide rails 2034, the lower guide rail 2341 is arranged more to the front than the upper guide rail 2342. Thus, the carriage 2028, which is arranged such that it extends between the two guide rails 2341 and 2342, moves in a tilted state in which its upper section is positioned to the rear and its lower section is positioned to the front.

The linear encoder code plate 2019 is provided on and along the upper guide rail 2342 by which the carriage 2028 is guided. The linear encoder code plate 2019 is arranged such that it is in opposition to a detecting section of the linear encoder 2017 that is fixed to the carriage 2028, which moves along the guide rails 2034. The linear encoder 2017 will be described in detail later.

The pull belt 2032 is formed in an annular shape, and is extended at a central position between the upper and lower guide rails 2341 and 2342 between two pulleys 2044 and 2045 that are spaced apart from each other by a distance approximately equal to the length of the guide rails 2341 and 2342. One pulley 2044, of the two pulleys 2044 and 2045, is connected to the carriage motor 2030.

The carriage 2028, which is arranged such that it extends between the two guide rails 2341 and 2342, has an engaging portion 2046 at which the pull belt 2032 is fixed to the carriage 2028 approximately at the center in the vertical direction. The color printer 2020 prints on the roll paper P, which is fed by the print paper carrying section 2005, by pulling the carriage 2028 with the pull belt 2032 that is driven by the carriage motor 2030 to move the carriage 2028 in the main-scanning direction along the guide rails 2034, and by ejecting ink from the eight print heads 2036 provided on the carriage 2028. At this time, the carriage 2028 moves due to a drive force of the carriage motor 2030 transmitted via the pull belt 2032. In other words, the engaging portion 2046 is the section of the carriage 2028 to which an external force for moving the carriage 2028 is applied.

In the present embodiment, eight print heads 2036 are provided on the carriage 2028, each of these print heads 2036 includes a plurality of nozzles n as ink ejecting sections for ejecting ink, and ink is ejected from predetermined ones of the nozzles n under the control of a head control unit 2063 (see FIG. 16) described below. The surface of the print head 2036 that is in opposition to the roll paper P has a plurality of nozzle rows N, which serve as ink ejecting section rows. In each of the nozzle rows N, the plurality of nozzles n are arranged in a row in the sub-scanning direction. These nozzle rows N are arranged parallel to each other in the main-scanning direction. The arrangement of the print heads 2036 and the nozzles n will be described later.

The print paper carrying section 2005 is arranged on the rear side of the two guide rails 2034. The print paper carrying section 2005 includes a roll paper holding section 2035, a roll paper carrying section 2037, and a platen 2026. The roll paper holding section 2035 is arranged below the lower guide rail 2341 and holds the roll paper P rotatably together with a holder 2027. The roll paper carrying section 2037 is arranged above the upper guide rail 2342 and carries the roll paper P. The roll paper P, which is carried between the roll paper holding section 2035 and the roll paper carrying section 2037, is carried over the platen 2026. The platen 2026 has a flat surface across the entire width of the roll paper P that is carried. This flat surface is tilted such that it is in opposition to each of the print heads 2036, which are provided on the carriage 2028 movable in a tilted state, at an equal spacing.

The holder 2027 has a shaft 2027*a* which serves as a rotating shaft in a state where the roll paper P is held. Guide disks 2027*b* for preventing undulation of the supplied roll paper P are disposed on both sides of the shaft 2027*a*.

The roll paper carrying section 2037 has a paper feed roller (SMAP roller) 2024 for carrying the roll paper P, clamping rollers 2029 arranged in opposition to the paper feed roller 2024 and clamping the roll paper P between them and the paper feed roller 2024, and a carry motor 2031 for rotating the paper feed roller 2024. A driving gear 2040 is arranged on a shaft of the carry motor 2031, and a relay gear 2041 meshing with the driving gear 2040 is provided on the shaft of the paper feed roller 2024. The drive force of the carry motor 2031 is transmitted to the paper feed roller 2024 via the driving gear 2040 and the relay gear 2041. That is to say, the roll paper P that is held by the holder 2027 is clamped between the paper feed roller 2024 and the clamping rollers 2029, and the roll paper P is carried along the platen 2026 by the carry motor 2031.

Encoder

Figure 12:
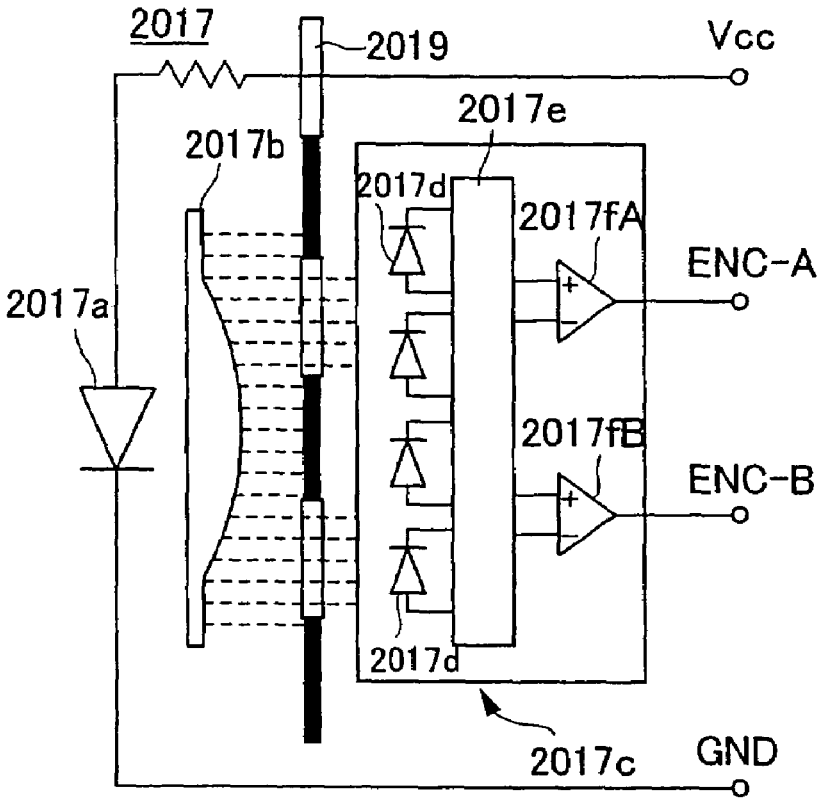
FIG. 12 is an explanatory diagram schematically showing a configuration of a linear encoder.

Next, the linear encoder 2017 provided on the carriage 2028 is described. FIG. 12 is an explanatory diagram that schematically shows the configuration of the linear encoder 2017 attached to the carriage 2028.

The encoder 2017 shown in FIG. 12 is provided with a light emitting diode 2017*a*, a collimating lens 2017*b*, and a detection processing section 2017*c*. The detection processing section 2017*c* has a plurality of (for example, four) photodiodes 2017*d*, a signal processing circuit 2017*e*, and, for example, two comparators 2017*f*A and 2017*f*B.

The light-emitting diode 2017*a* emits light when a voltage VCC is applied to both sides thereof via resistors. This light is condensed into parallel light by the collimating lens 2017*b* and passes through the linear encoder code plate 2019. The linear encoder code plate 2019 is provided with slits at predetermined intervals (for example, 1/180 inch (one inch=2.54 cm)).

The parallel light that has passed through the linear encoder code plate 2019 then passes through stationary slits (not shown) and is incident on the photodiodes 2017*d*, where it is converted into electrical signals. The electrical signals that are output from the four photodiodes 2017*d* are subjected to signal processing by the signal processing circuit 2017*e*, the signals that are output from the signal processing circuit 2017*e* are compared by the comparators 2017*f*A and 2017*f*B, and the results of these comparisons are output as pulses. Then, the pulse ENC-A and the pulse ENC-B that are output from the comparators 2017*f*A and 2017*f*B become the output of the encoder 2017.

Figure 13A:
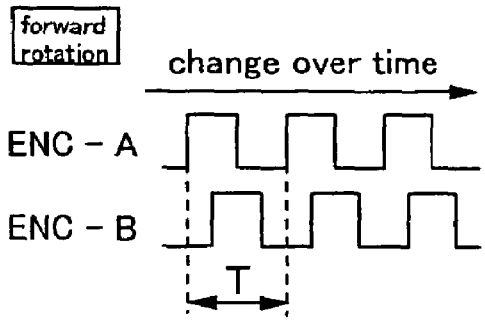
FIG. 13A and FIG. 13B are timing charts showing waveforms of two output signals of the linear encoder.
Figure 13B:
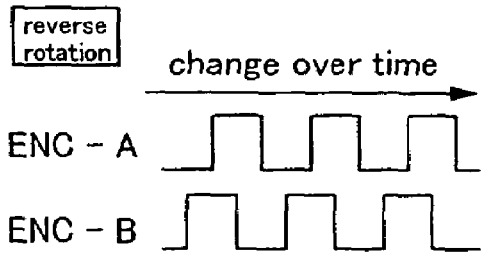

FIG. 13A and FIG. 13B are timing charts showing the waveforms of the two output signals of the encoder 2017 when the carriage motor is rotating forward and rotating in reverse, respectively.

As shown in FIG. 13A and FIG. 13B, the phases of the pulse ENC-A and the pulse ENC-B are misaligned by 90 degrees both when the carriage motor is rotating forward and when it is rotating in reverse. When the carriage motor 2030 is rotating forward, that is, when the carriage 2028 is moving in the main-scanning direction, then, as shown in FIG. 13A, the phase of the pulse ENC-A leads the phase of the pulse ENC-B by 90 degrees. On the other hand, when the carriage motor 2030 is rotating in reverse, then, as shown in FIG. 13B, the phase of the pulse ENC-A is delayed by 90 degrees with respect to the phase of the pulse ENC-B. A single period T of the pulse ENC-A and the pulse ENC-B is equivalent to the time during which the carriage 2028 moves for the slit interval of the linear encoder code plate 2019.

In the present embodiment, the width of each slit (section shown in white) of the linear encoder code plate 2019 is twice the resolution of the color printer 2020, and here, it is equal to 360 dpi, for example. That is, when the carriage 2028 moves in the main-scanning direction, it is detected that the carriage 2028 has moved for a distance amounting to 360 dpi every time a pulse is output from the encoder 2017. Therefore, it becomes possible to detect the position, in the main-scanning direction, of the carriage 2028 by first recognizing a home position, which is set in advance as a standby position of the carriage 2028, at the time of, for example, an initial operation for when the color printer 2020 is turned ON, and then counting the number of pulses that are output from the linear encoder 2017.

It is also possible to detect the position of the carriage 2028 at a higher resolution than that of the slits of the linear encoder code plate 2019 by dividing each of the pulses output from the linear encoder 2017 into equal parts. For example, by dividing a pulse output from the linear encoder 2017 into four, it is possible to detect and control the position of the carriage 2028 at a precision of 1440 dpi.

Configuration of the Print Heads

Figure 14:
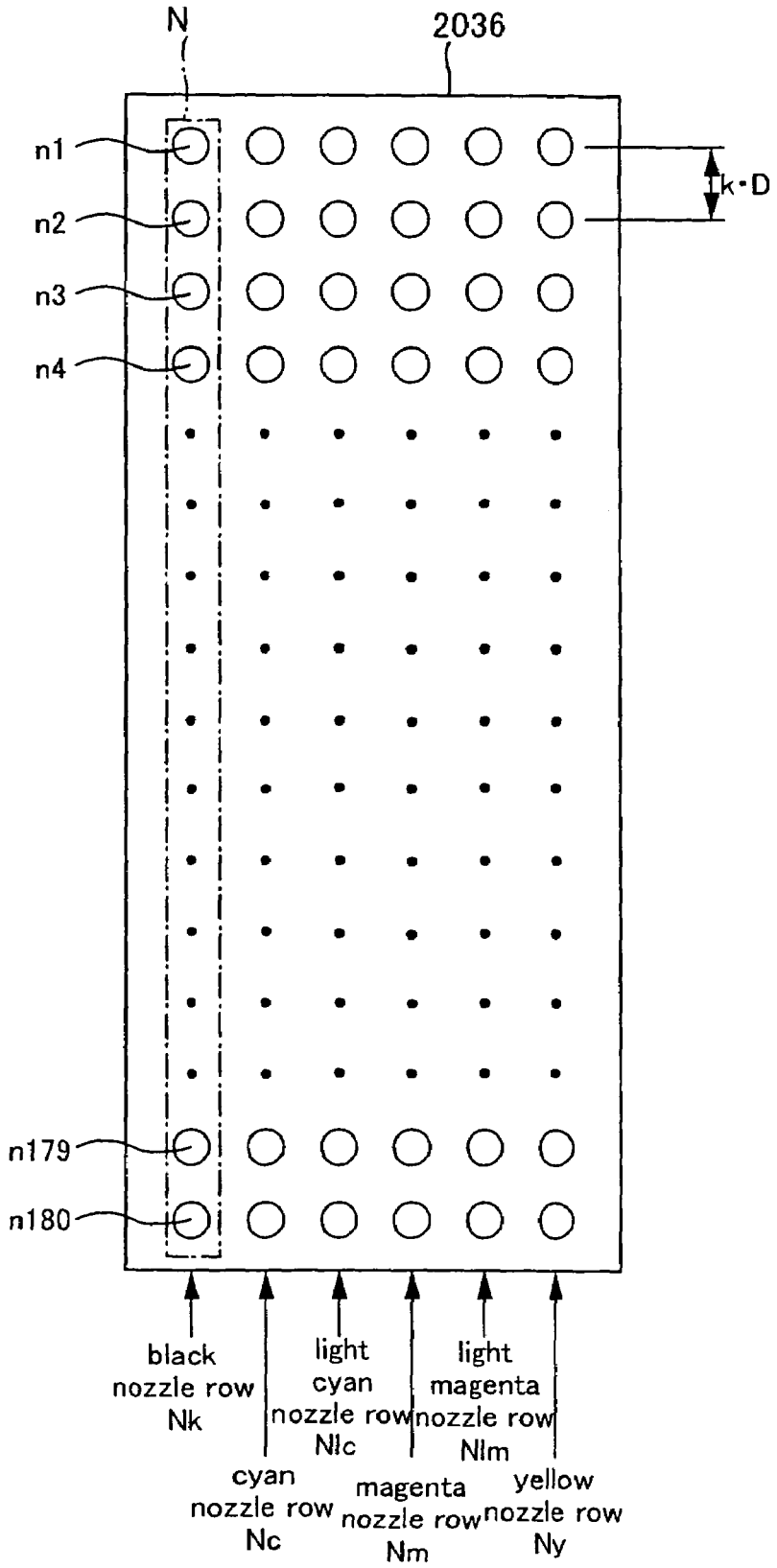
FIG. 14 is an explanatory diagram for illustrating nozzle rows of a print head.
Figure 15:
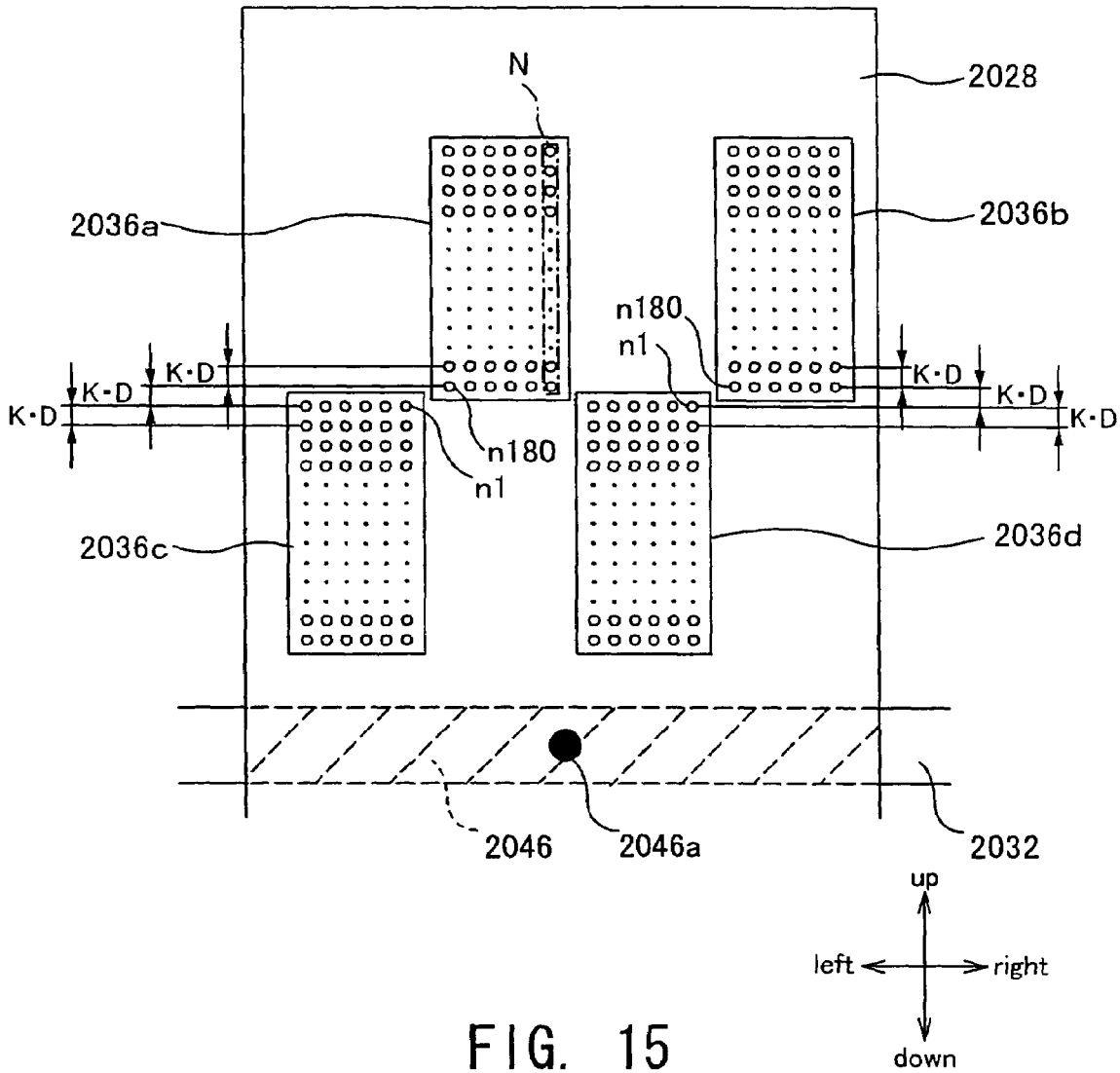
FIG. 15 is a diagram for illustrating an arrangement of nozzles among a plurality of adjacent print heads and the center of a section to which an external force is applied.

Next, the configuration of the print heads 2036 is described using FIG. 10, FIG. 14 and FIG. 15. FIG. 14 is an explanatory diagram illustrating the arrangement of the nozzles of the print heads 2036. FIG. 15 is a diagram showing the arrangement of a plurality of adjacent print heads 2036, and the positional relationship between the nozzle rows of these print heads 2036.

As shown in FIG. 14, each of the print heads 2036 has six nozzle rows N serving as recording portion rows, in which a plurality of nozzles n are arranged on a straight line in the sub-scanning direction. In the present embodiment, a row is arranged for each color of ink that is ejected, that is, there are a black nozzle row Nk, a cyan nozzle row Nc, a light cyan nozzle row Nlc, a magenta nozzle row Nm, a light magenta nozzle row Nlm, and a yellow nozzle row Ny, as the nozzle rows N. However, there is no limitation to this arrangement.

The black nozzle row Nk has 180 nozzles, namely nozzles n1 to n180. Each of these nozzles n is provided with a piezoelectric element (not shown) as a driving element for driving the nozzle and making it eject ink droplets. The nozzles n1, . . . , n180 of the black nozzle row Nk are arranged at a constant nozzle pitch k·D in the sub-scanning direction. Here, D is the dot pitch in the sub-scanning direction, and k is an integer of 1 or greater. The dot pitch D in the sub-scanning direction is equal to the pitch of the main scan lines (raster lines). Hereinafter, the integer k expressing the nozzle pitch k·D is referred to simply as the "nozzle pitch k." In the example of FIG. 14, the nozzle pitch k is four dots. The nozzle pitch k, however, may be set to any integer.

The above-described explanations also apply for the cyan nozzle row Nc, the light cyan nozzle row Nlc, the magenta nozzle row Nm, the light magenta nozzle row Nlm, and the yellow nozzle row Ny. That is, each of these nozzle rows N has 180 nozzles n1 to n180 arranged at a constant nozzle pitch k·D in the sub-scanning direction.

During printing, droplets of ink are ejected from the nozzles n as the roll paper P is carried intermittently for a predetermined carry amount by the print paper carrying section 2005 while the carriage 2028 is moved in the main-scanning direction during these intermittent carryings. However, depending on the print mode, that is, when printing is carried out, for example, in the interlace mode for printing natural pictures etc., not all of the nozzles n are used necessarily, and there may also be instances in which only some of the nozzles n are used.

Of the eight print heads 2036 on the carriage 2028, four print heads 2036 are arranged above the pull belt 2032 and the remaining four print heads 2036 are arranged below the pull belt 2032. The positional relation among the four upper print heads 2036 and the positional relation among the four lower print heads 2036 are the same; therefore, here, only the positional relation of the four upper print heads 2036 is explained as an example.

The four print heads 2036 are arranged such that two print heads, i.e., upper-side print heads 2036*a* and 2036*b* positioned on the side further from the section to which an external force for moving the carriage 2028 is applied, that is, from the engaging portion 2046, and two print heads, i.e., lower-side print heads 2036*c* and 2036*d* positioned on the side close to the engaging portion 2046 are arranged in the vertical direction. The two upper-side print heads 2036*a* and 2036*b*, as well as the two lower-side print heads 2036*c* and 2036*d*, are spaced apart from each other in the lateral direction at a length that is approximately equal to the width of the print head 2036. The upper-side print head 2036*b* on the right is located at the right end of the carriage 2028. The lower-side print head 2036*c* on the left is located at the left end of the carriage 2028. That is, among the four print heads 2036*a*, 2036*b*, 2036*c*, and 2036*d*, the two print heads 2036*a* and 2036*c* on the left form a pair and the two print heads 2036*b* and 2036*d* on the right form another pair. In each pair of print heads 2036, the print heads 2036*c* and 2036*d* on the left are located on the lower side, and the print heads 2036*a* and 2036*b* on the right are located on the upper side; that is, the four print heads 2036 are in a staggered arrangement. The four print heads arranged below the pull belt 2032 are also arranged such that there are two print heads in two layers in the vertical direction. It is needless to say, however, that in the four lower print heads, the upper-side print heads 2036*e* and 2036*f* are positioned on the side close to the engaging portion 2046 in the sub-scanning direction, and the lower-side print heads 2036*g* and 2036*h* are positioned on the side further from the engaging portion 2046 in the sub-scanning direction.

Moreover, as shown in FIG. 15, as for the four print heads 2036 arranged above the pull belt 2032, the lowermost nozzle n180 of each nozzle row N in each of the upper-side print heads and the uppermost nozzle n1 of each nozzle row N in each of the lower-side print heads are arranged at a pitch equal to the nozzle pitch of each nozzle row N. That is, as for the two print heads 2036*a* and 2036*c* arranged on the left, the distance, in the vertical direction, between the lowermost nozzle n180 (the rearmost nozzle in the paper carrying direction) of each nozzle row N in the upper right print head 2036*a* and the uppermost nozzle n1 (the foremost nozzle in the paper carrying direction) of each nozzle row N in the lower left print head 2036*c* is arranged so that it is equal to the nozzle pitch k·D. In the same way, as for the two print heads 2036*b* and 2036*d* arranged on the right, the distance, in the vertical direction, between the lowermost nozzle n180 of each nozzle row N in the upper right print head 2036*b* and the uppermost nozzle n1 of each nozzle row N in the lower left print head 2036*d* is arranged so that it is equal to the nozzle pitch k·D. Therefore, assuming that the two left print heads 2036*a* and 2036*c* form a print head group and the two right print heads 2036*b* and 2036*d* form another print head group, when each nozzle row N in each print head group forms dots on the roll paper P at the same position in the main-scanning direction during one scan movement of the carriage, the dots formed by the nozzle rows N of the two print heads 2036 in the same group will form a continuous line at a constant pitch.

It should be noted that in FIG. 14, the ink colors of each of the nozzle rows N were, in order from the left side in the figure, the black nozzle row Nk, the cyan nozzle row Nc, the light cyan nozzle row Nlc, the magenta nozzle row Nm, the light magenta nozzle row Nlm, and the yellow nozzle row Ny; however, this is not a limitation, and it is also possible for the ink colors of the nozzle rows N to be arranged in a different order.

Example of an Overall Configuration of a Liquid Ejecting System

Figure 16:
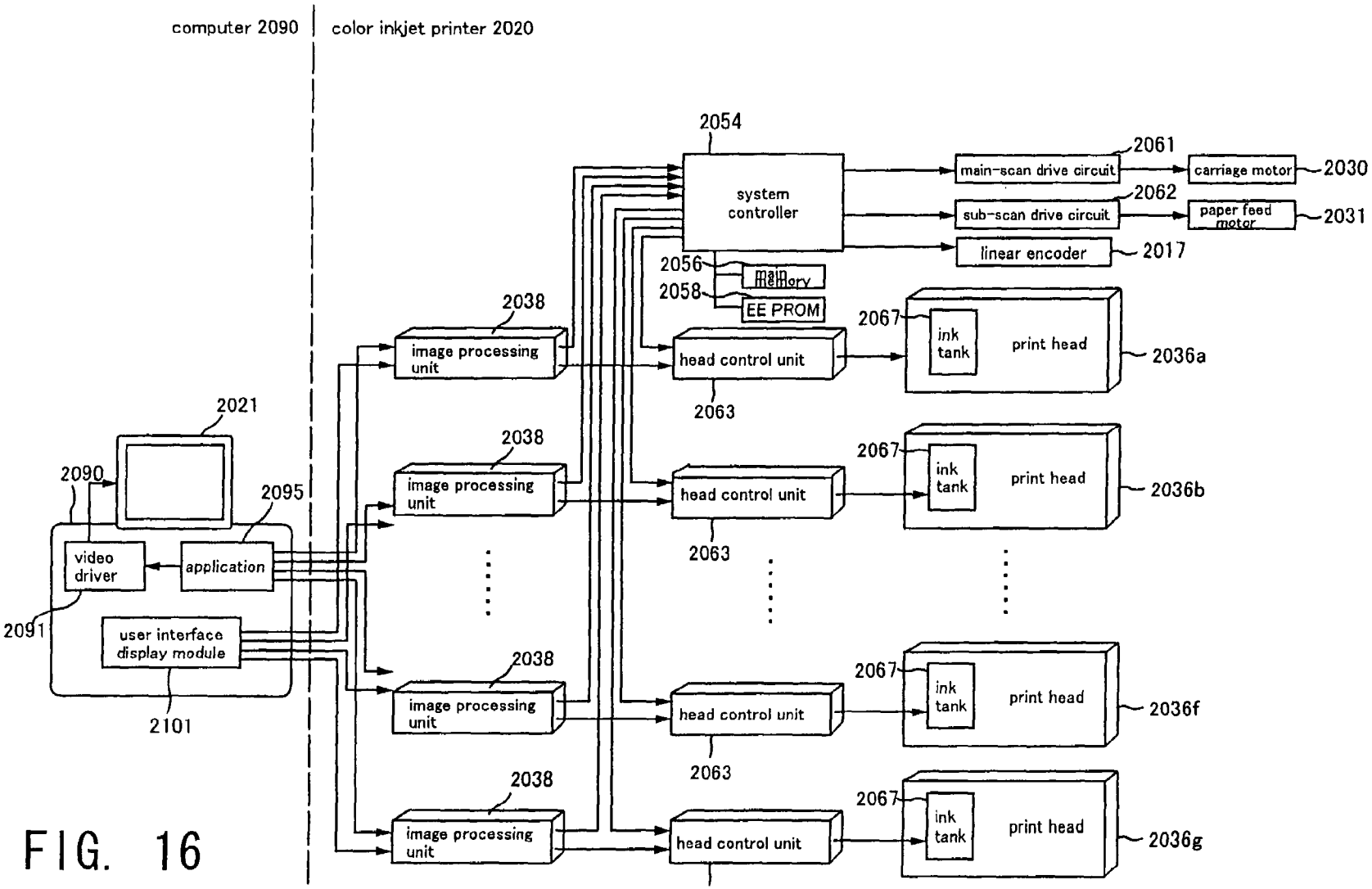
FIG. 16 is a block diagram showing a configuration of a liquid ejecting system provided with the color printer.
Figure 17:
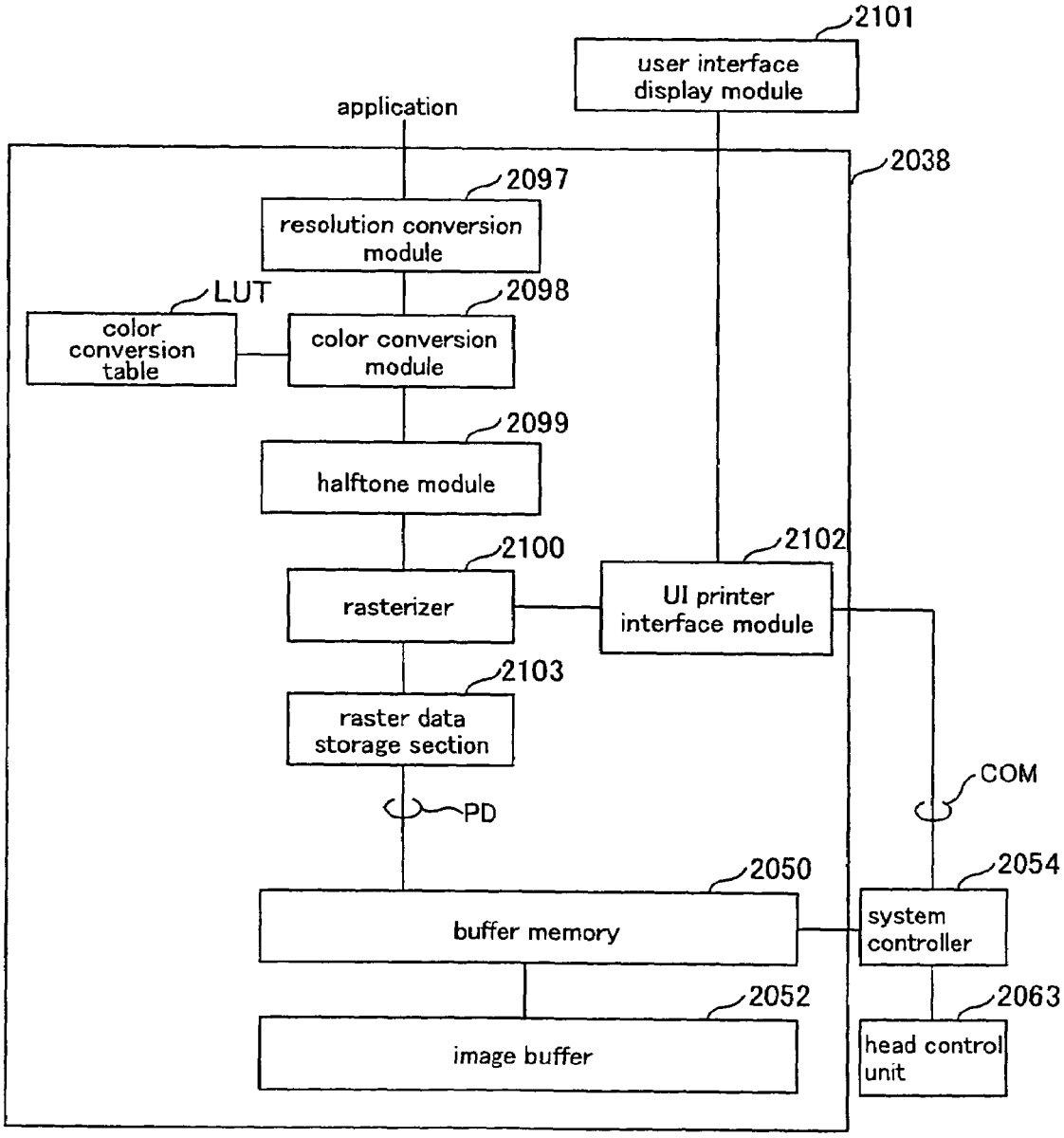
FIG. 17 is a block diagram showing a configuration of an image processing unit.

Next, an example of an overall configuration of a liquid ejecting system is described with reference to FIG. 16 and FIG. 17. FIG. 16 is a block diagram showing the configuration of a liquid ejecting system provided with the color printer 2020 described above. FIG. 17 is a block diagram showing the configuration of an image processing unit 2038.

This liquid ejecting system is provided with a computer 2090 and the color printer 2020, which is an example of a liquid ejecting apparatus. It should be noted that the liquid ejecting system including the color printer 2020 and the computer 2090 can also be referred to as the "liquid ejecting apparatus" in a broad sense. This system is made of the computer 2090, the color printer 2020, a display device such as a CRT 2021 or a liquid crystal display device (not shown), input devices (not shown) such as a keyboard and a mouse, and a drive device (not shown) such as a flexible drive device or a CD-ROM drive device.

In the computer 2090, an application program 2095 is executed under a predetermined operating system. The operating system includes a video driver 2091, and the application program 2095, which is for retouching images, for example, carries out desired processing with respect to images to be processed, and also displays the images on the CRT 2021 through the video driver 2091.

The color printer 2020 includes image processing units 2038, a system controller 2054, a main memory 2056, and an EEPROM 2058. Print data etc. is input from the application program 2095 into the image processing units 2038, which serve as information generators. The system controller 2054 controls the operation of the overall color printer 2020. Further connected to the system controller 2054 are a main-scan drive circuit 2061 for driving the carriage motor 2030, a sub-scan drive circuit 2062 for driving the carry motor 2031, head control units 2063 serving as controllers for controlling the print heads 2036, and the linear encoder 2017 for detecting the operation of the carriage 2028.

As shown in FIG. 10, FIG. 11 and FIG. 16, the color printer 2020 has a plurality of print heads 2036. In the present embodiment, eight print heads 2036 are installed on the carriage 2028, the print heads 2036 are arranged spaced apart from each other in the vertical and lateral directions on the carriage 2028, and each print head 2036 is configured to be attachable to and detachable from the printer body.

Further, each print head 2036 has an ink tank 2067 for containing the ink that is to be supplied to the nozzles n of that print head 2036. Each print head 2036 also has the head control unit 2063 and the image processing unit 2038 described above, and thus, it is possible to control the print heads 2036 individually based on a drive signal that serves as a reference.

When the application program 2095 issues a print command, the image processing units 2038 provided in the color printer 2020 receive image data from the application program 2095 and convert the data into print data PD. As shown in FIG. 17, the image processing units 2038 are internally provided with a resolution conversion module 2097, a color conversion module 2098, a halftone module 2099, a rasterizer 2100, a UI printer interface module 2102, a raster data storage section 2103, a color conversion lookup table LUT, a buffer memory 2050, and an image buffer 2052.

The role of the resolution conversion module 2097 is to convert the resolution of the color image data formed by the application program 2095 into the corresponding print resolution based on information such as the print mode received with the image data. The image data whose resolution has been thus converted at this point is still image information made of the three color components RGB. Referencing the color conversion lookup table LUT, the color conversion module 2098 converts for each pixel the RGB image data into multi-gradation data of a plurality of ink colors that can be used by the color printer 2020.

The multi-gradation data that has been color converted has, for example, 256 gradation values. The halftone module 2099 executes so-called halftone processing to generate halftone image data. Here, for example, "halftoning" involves dividing an image into regions each made up of a plurality of portions (a pixel can be formed in each of these portions), and expressing the darkness of each region by whether or not to form either a large dot, a medium dot, or a small dot in each of the portions that make up that region.

The halftone image data is arranged by the rasterizer 2100 into a desired data order, and is output as the final print data PD to the raster data storage section 2103. Here, signals instructing to form dots for printing sections of the image in halftone are assigned to print heads 2036 that are positioned on the side close to the pull belt 2032 described above.

On the other hand, the user interface display module 2101 provided in the computer 2090 has the function to display various types of user interface windows related to printing and the function to receive input from the user through these windows. For example, the user can specify the type and size of the print paper, or the print mode, for example, using the user interface display module 2101.

The UI printer interface module 2102 functions as an interface between the user interface display module 2101 and the color printer 2020. It interprets instructions given by users through the user interface and sends various commands COM to the system controller 2054, for example, or conversely, it interprets commands COM received from the system controller 2054, for example, and executes various displays on the user interface. For example, the instructions regarding the type or the size of the print paper, for example, that are received by the user interface display module 2101 are sent to the UI printer interface module 2102, which interprets these instructions and sends commands COM to the system controller 2054.

The UI printer interface module 2102 also functions as a print mode setting section. That is, the UI printer interface module 2102 determines the print mode, which is the recording mode, based on print information received by the user interface display module 2101, namely, information about the resolution of the printed image and the nozzles used for the printing, and information related to the data indicating the sub-scanning feed amount. Then, print data PD corresponding to the print mode is generated by the halftone module 2099 and the rasterizer 2100, and is output to the raster data storage section 2103. The print data PD that is output to the raster data storage section 2103 is temporarily stored in the buffer memory 2050, converted into data corresponding to the nozzles, and stored in the image buffer 2052. The system controller 2054 of the color printer 2020 controls the main-scan drive circuit 2061, the sub-scan drive circuit 2062, the head control units 2063, and so forth, based on the information of the commands COM that are output by the UI printer interface module 2102, and performs printing by driving the nozzles for the various colors that are provided on the print heads 2036 based on the data from the image buffer 2052. Here, as print modes, there are, for example, a high image-quality print mode in which dots are recorded using the so-called interlace mode, and a high-speed mode in which dots are recorded without using the interlace mode.

Driving the Print Head

Next, the driving of the print head 2036 is described below with reference to FIG. 18.

Figure 18:
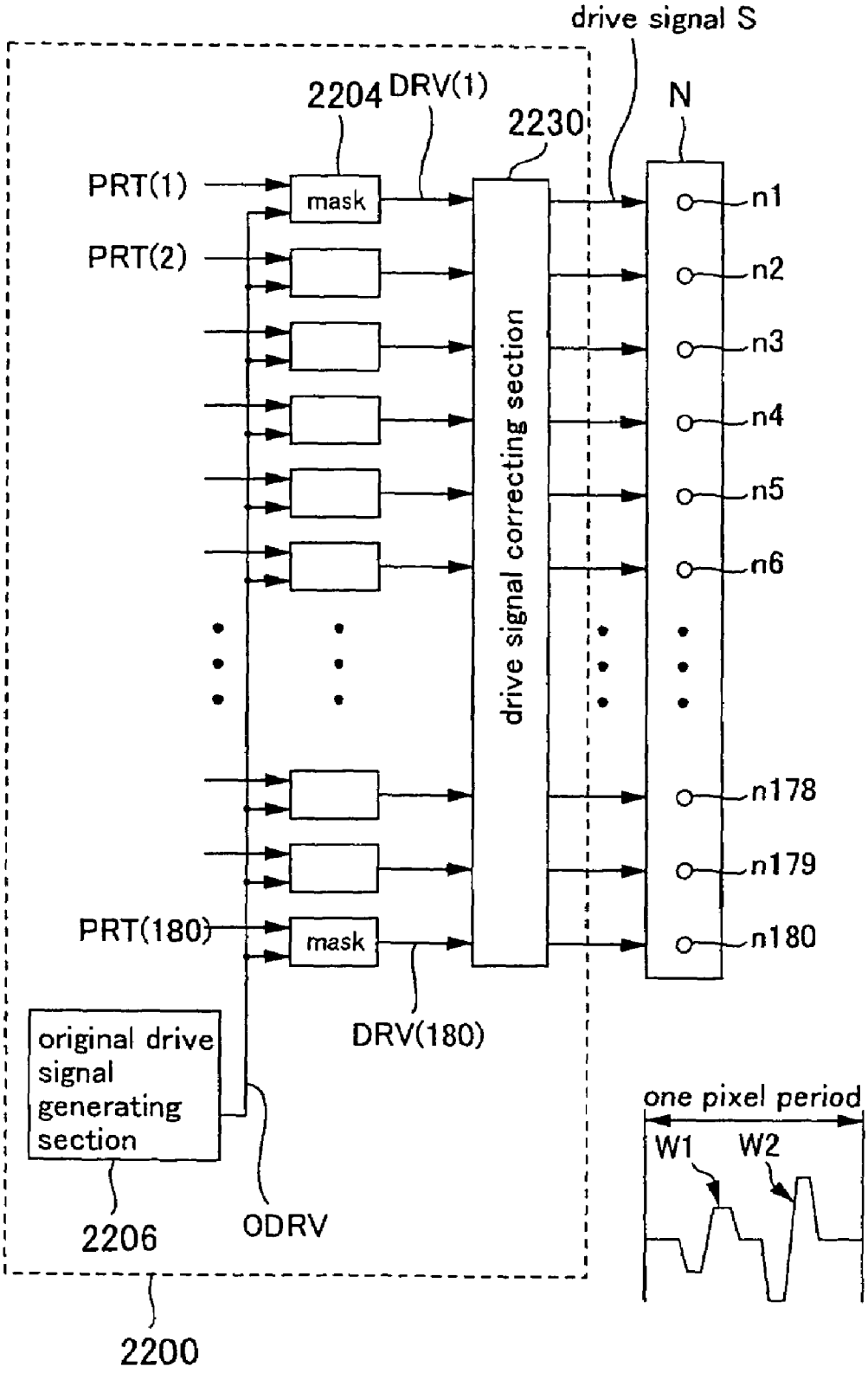
FIG. 18 is a diagram showing a configuration of a drive signal generating section provided in a head control unit.
Figure 19:
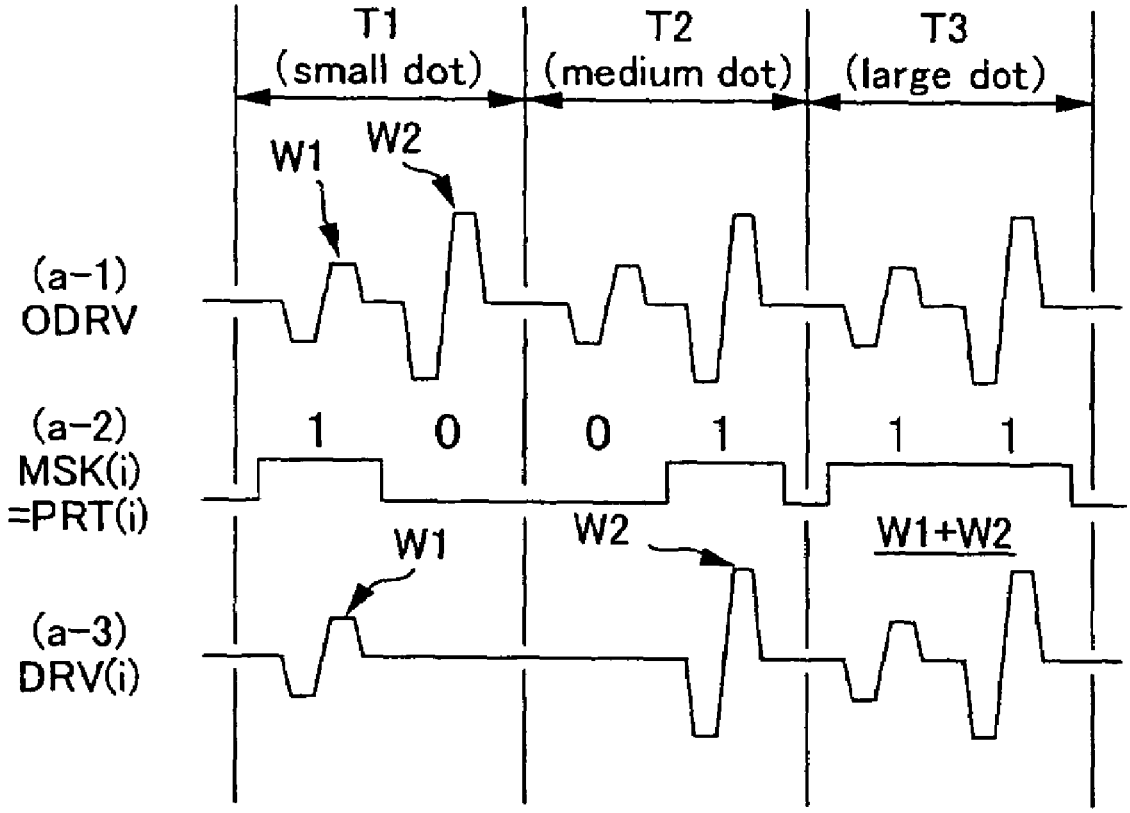
FIG. 19 is a timing chart for illustrating the operation of the drive signal generating section.

FIG. 18 is a block diagram showing the configuration of a drive signal generating section provided in the head control unit 2063 (FIG. 16). FIG. 19 is a timing chart of an original signal ODRV, a print signal PRT(i), and a drive signal DRV(i) for illustrating the operation of the drive signal generating section. In FIG. 18, the drive signal generating section 2200 includes a plurality of mask circuits 2204, an original drive signal generating section 2206, and a drive signal correcting section 2230. The mask circuits 2204 are provided corresponding to each of the plurality of piezoelectric elements for driving each of the nozzles n1 through n180 of the print head 2036. Note that in FIG. 18, the number in parentheses attached to the end of each signal name indicates the number of the nozzle to which the signal is supplied.

The original drive signal generating section 2206 generates original drive signals ODRV used in common among the nozzles n1 through n180. The original drive signal ODRV is a signal that includes two pulses—a first pulse W1 and a second pulse W2—during the main scan period for one pixel, and serves as a reference ejection signal for causing each nozzle to eject ink. That is, all of the nozzles of one print head 2036 eject ink based on the same original drive signal ODRV, and when it is detected that the carriage 2028 has reached a predetermined position based on the output of the linear encoder 2017, outputting of the original drive signal ODRV is started. Therefore, the output timing of the original drive signal ODRV is adjusted such that when dot rows are formed, as liquid droplet mark rows, at the same target position on the print paper by ejecting ink from the nozzle rows of the print heads 2036, the positions, in the main-scanning direction, of the dot rows coincide with each other. More specifically, before this adjustment is made, a logical value for ejecting ink at a target position on the print paper from the above-described predetermined position is set as an initial value based on the relative position between the carriage 2028 and the print paper, the distance in the main-scanning direction between the print heads, the distance in the main-scanning direction between the nozzle rows of the print heads, etc., and this value (initial value) that has been set is stored in the EEPROM. The method for adjusting the positions of the dot rows formed by the print heads according to the output timing of the original drive signal ODRV will be described later.

The drive signal correcting section 2230 can change the positions at which the dots are formed individually by shifting, either forward or backward, the timing of the drive signal waveform that has been shaped by each mask circuit 2204. By shifting the timing of the drive signal waveform, it is possible to print the print patterns 10 and 12 (see FIG. 20 and FIG. 21) that are used for adjusting the output timing of the original drive signal ODRV which is supplied to each print head. The print patterns 10 and 12 and the method for printing the print pattern 10 will be described later.

As shown in FIG. 18, input serial print signals PRT(i) are input to the mask circuits 2204 along with the original drive signal ODRV that is output from the original drive signal generating section 2206. The serial print signal PRT(i) is a serial signal made of two bits per pixel, and each bit corresponds to the first pulse W1 and the second pulse W2, respectively. Each mask circuit 2204 is a gate for masking the original drive signal ODRV according to the level of the serial print signal PRT(i). That is, if the serial print signal PRT(i) is at level 1, the mask circuit 2204 lets the corresponding pulse of the original drive signal ODRV pass right through so that the pulse is supplied to the piezoelectric element as a drive signal DRV, whereas if the serial print signal PRT(i) is at level 0, the mask circuit 2204 cuts off the corresponding pulse of the original drive signal ODRV.

As shown in FIG. 19, the original drive signal generating section 2206 generates an original drive signal ODRV in which the first pulses W1 and the second pulses W2 alternately appear for each of the pixel periods T1, T2, and T3. It should be noted that the term "pixel period" has the same meaning as the main scan period for one pixel.

As shown in FIG. 19, when the print signal PRT(i) has a waveform corresponding to 2-bit pixel data "1, 0", then only the first pulse W1 is output during the first half of the pixel period. Accordingly, a small ink droplet is ejected from the nozzle, and a small dot is formed on the medium to be printed. On the other hand, when the print signal PRT(i) has a waveform corresponding to 2-bit pixel data "0, 1", then only the second pulse W2 is output during the latter half of the pixel period. Accordingly, a medium-sized ink droplet is ejected from the nozzle, and a medium-sized dot (medium dot) is formed on the medium to be printed. Further, when the print signal PRT(i) has a waveform corresponding to 2-bit pixel data "1, 1", then both the first pulse W1 and the second pulse W2 are output during the pixel period. Accordingly, a large ink droplet is ejected from the nozzle, and a large dot is formed on the medium to be printed. That is, the drive signal DRV(i) for one pixel period is shaped so that its waveform is in one of the three different shapes according to the three different values of the print signal PRT(i). According to these signals, the print head 2036 is enabled to form dots in three sizes.

Method for Adjusting the Positions of Dot Rows formed by Print Heads

In the present embodiment, all of the nozzles of a print head 2036 eject ink based on an original drive signal ODRV output at an output timing that is the same within each print head. Therefore, the output timing of the original drive signal ODRV for driving each print head 2036 is adjusted such that the positions, in the main-scanning direction, of the actually-formed dots coincide with each other when liquid droplets are ejected to form dots at the same target position on the roll paper P with each of the print heads. Here, the print heads 2036 are adjusted with respect to an original drive signal ODRV that is output to one of the print heads 2036 that serves as a reference. Further, when ink is ejected according to an original drive signal ODRV output at an output timing that is the same within each print head, the appropriate output timing differs for when printing is carried out using achromatic color ink and for when printing is carried out using chromatic color ink. Therefore, adjustment of the output timing of the original drive signal ODRV differs for the two cases.

It is preferable that the print head 2036 serving as the reference (which is referred to as "reference print head" below) is relatively stable in behavior upon scan movement of the carriage 2028 and that the positions of the dots formed thereby do not vary. Therefore, the print head 2036 closest, in the sub-scanning direction, to the engaging portion 2046 to which the external force is applied with respect to the carriage 2028 is adopted as the reference print head. Since the carriage 2028 moves back and forth in the main-scanning direction, the way in which the external force is applied to the engaging portion 2046 differs for when the carriage 2028 moves in the forward pass direction and when the carriage 2028 moves in the return pass direction, and thus, the behavior of the carriage 2028 will be different in each direction. Therefore, the print heads 2036*d* and 2036*e*, which are positioned close to the center 2046*a* of the engaging portion 2046, become the print heads 2036 that are relatively stable in behavior during both the forward and return scan movements. Accordingly, the print heads 2036*d* and 2036*e* are adopted as the reference print heads in order to perform adjustment with improved precision. That is, in the present embodiment, the output timing of the original drive signal ODRV is adjusted, taking the original drive signals ODRV supplied to the print heads 2036*d* and 2036*e* that are positioned closest to the center of the carriage 2028 as the reference. It should be noted that among the eight print heads 2036, the four print heads 2036 above the pull belt 2032 and the four print heads 2036 below it are arranged in the same way, and therefore, only the upper four print heads will be described below.

Adjusting the Output Timing for when Printing is Carried Out Using Achromatic Color Ink The positions, in the main-scanning direction, of dots formed with achromatic color ink, i.e., black ink, are adjusted. More specifically, the output timing of the original drive signal ODRV supplied to the upper right print head 2036*b* is adjusted with reference to the output timing of the original drive signal ODRV supplied to the lower right print head 2036*d* in FIG. 15 that serves as the reference print head.

When the carriage 2028 performs a scan movement in the direction towards the left in FIG. 10 (which is referred to as "forward pass scan movement" below), the target print head 2036*b*, which is installed on the same carriage 2028 as the reference print head 2036*d*, will reach a target position after the reference print head 2036*d* forms a first dot row. Therefore, the output timing of the original drive signal ODRV supplied to the target print head 2036*b* is set in advance such that the original drive signal ODRV is output delayed by an amount of time required for the carriage 2028 to move for an ideal distance, in the main-scanning direction, between the black nozzle row Nk of the reference print head 2036*d* and the black nozzle row Nk of the target print head 2036*b*, which is the target of output timing adjustment.

The adjustment of the output timing of the original drive signal ODRV is performed by printing, during a forward pass scan movement of the reference print head 2036*d* and the target print head 2036*b*, a print pattern 10 that includes a reference dot row formed by ejecting ink from the black nozzle row Nk of the reference print head 2036*d* and an adjustment-target dot row formed by ejecting ink from the black nozzle row Nk of the target print head 2036*b* with respect to a predetermined position on the roll paper P as a target position, and determining the optimum output timing based on the print pattern 10 that is printed. Here, the relative position between the carriage 2028 and the roll paper P is detected based on the output of the linear encoder 2017.

Figure 20:
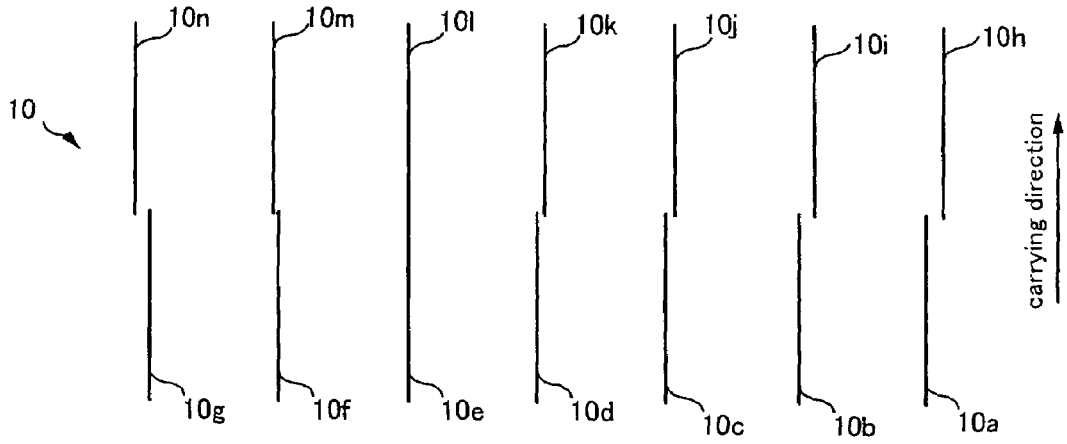
FIG. 20 is a diagram for illustrating a print pattern for determining the optimum output timing when printing is carried out using achromatic color ink.

FIG. 20 is a diagram for illustrating the print pattern for determining the optimum output timing when printing is carried out using achromatic color ink.

In the forward pass scan movement of the carriage 2028, the reference print head 2036*d* ejects ink from the black nozzle row Nk with respect to the predetermined target position in the main-scanning direction on the roll paper P to thereby form a first dot row 10*a* in the carrying direction. After forming the first dot row 10*a*, the reference print head 2036*d* ejects ink, for example, six times at constant time intervals to thereby form a total of seven dot rows 10*a* through 10*g* on the upstream side in the carrying direction at appropriate intervals, as shown in FIG. 20.

At this time, the target print head 2036*b* forms seven dot rows, i.e., an eighth dot row 10*h* to a fourteenth dot row 10*n*, by ejecting ink in order to form dots at the same target positions as those of the reference print head 2036*d*. However, the seven dot rows, i.e., the eighth dot row 10*h* to the fourteenth dot row 10*n*, are printed by successively changing the ink ejection timing with the drive signal correcting section 2230. More specifically, ink is ejected to form those dot rows at timings that have been corrected with the drive signal correcting section 2230 such that the eleventh dot row 10*k*, which is formed by ejecting ink at the output timing that is set in advance such that ink is ejected at the same target position as the reference print head 2036*d*, is positioned at the center (i.e., fourth) of the seven dot rows, and such that the eighth dot row 10*h*, the ninth dot row 10*i*, the tenth dot row 10*j*, the twelfth dot row 10*l*, the thirteenth dot row 10*m*, and the fourteenth dot row 10*n*, which are formed before or after the eleventh dot row 10*k*, are successively shifted by a slight amount of time. The slight amount of time for correction is, for example, the amount of time required for the carriage 2028 to move for a distance obtained by dividing the inter-dot distance in the main-scanning direction (=1/180 inch) into eight, i.e., for 1/180 inch÷8=1/1440 inch, and this correction is made by the drive signal correcting section 2230.

In the print pattern of FIG. 20, the fifth dot row 10*e* formed by the reference print head 2036*d* and the twelfth dot row 10*l* formed by the target print head 2036*b* are printed continuously in the carrying direction. The twelfth dot row 10*l* is the dot row adjacent to the eleventh dot row 10*k*, which has been printed at the output timing set in advance to the target print head 36*b*. Therefore, the output timing of the original drive signal ODRV supplied to the target print head 2036*b* is adjusted, with respect to the output timing set in advance, by an amount of time required for the carriage 2028 to move for 1/1440 inch. In this way, adjustment is made so that the positions in the main-scanning direction of the dot row formed by the reference print head 2036*d* with respect to the predetermined target position and the dot row formed by the target print head 2036*b* match with each other.

The adjustment of the output timing of the original drive signal ODRV can be made easily by providing a user interface for displaying, on displaying means of the computer 2090 when the print pattern is printed, a message etc. that prompts a user, for example, to select the dot rows in the printed print pattern that have been printed continuously in the carrying direction and to enter the number etc. specifying those dot rows, and by making the user carry out operations in accordance with the user interface.

It should be noted that the method for adjustment is the same for when the print head 2036*a* is the target print head.

Further, the method for adjustment is also the same for when the print head 2036*c* is the target print head. Since, however, the print head 2036*c* and the reference print head 2036*d* are arranged next to each other in the main-scanning direction, the way the print pattern is printed is different. In this case, the print pattern is printed by first printing seven dot rows with either the reference print head 2036*d* or the target print head 2036*c* in either the forward pass scan movement or the return pass scan movement of the carriage 2028, then carrying the roll paper P for a distance amounting to the length of a dot row, and then printing seven dot rows with the other print head while the carriage 2028 is being moved in the same direction as above. In this case, since the roll paper P is carried between printing of dot rows by one of the print heads and printing of dot rows by the other print head, it becomes possible to adjust the positions, in the main-scanning direction, of the dot rows while taking into account also the precision in carrying the roll paper P. Further, for example, it is possible to print a print pattern in a scan movement of the carriage 2028 in one direction by ejecting ink from half of the nozzles of the reference print head 2036*d* that are positioned on the upstream side in the carrying direction, and ejecting ink from half of the nozzles of the target print head 2036*c* that are positioned on the downstream side in the carrying direction, to thereby print seven dot rows with each print head.

Here, the way of dividing the nozzles for ejecting ink in the reference print head 2036*d* and the target print head 2036*c* is not limited to dividing the nozzle row in half. For example, a nozzle row may be divided into four regions, and the reference print head 2036*d* may eject ink from the nozzles positioned in the first and third regions counted from the upstream side in the carrying direction, whereas the target print head 2036*c* may eject ink from the nozzles positioned in the second and fourth regions counted from the upstream side in the carrying direction. It should be noted that, as regards the adjustment of the positions of the dot rows for when the print head 2036*b* was taken as the target print head 2036*b* as described previously, it is also possible to adjust the positions, in the main-scanning direction, of the dot rows while taking into account also the precision in carrying the roll paper P by first forming dot rows with the reference print head 2036*d*, then carrying the roll paper P for a distance amounting to twice the length of a dot row, and then printing seven dot rows with the target print head 2036*b*.

Adjusting the Output Timing for when Printing is Carried Out Using Chromatic Color Ink Images such as natural pictures are mainly printed when printing is performed using chromatic color ink. Therefore, it is necessary to adjust the positions of the dots formed with inks of a plurality of colors ejected from the print heads. If, however, the output timing of the original drive signal ODRV is the same within each print head, then it will be difficult to adjust the positions of all of the dots that are formed by the inks of the plurality of colors. Therefore, when printing is performed using chromatic color ink, the positions, in the main-scanning direction, of the dots formed with light cyan ink and light magenta ink, which tend to affect image quality particularly for images such as natural pictures, are adjusted with respect to dots formed by a reference print head. More specifically, in this example, the output timing of the original drive signal ODRV for a target print head 2036*b* is adjusted so that the amount of positional misalignment in the main-scanning direction between the light cyan dot row formed by the reference print head 2036*d* and the light cyan dot row formed by the target print head 2036*b* and the amount of positional misalignment in the main-scanning direction between the light magenta dot row formed by the reference print head 2036*d* and the light magenta dot row formed by the target print head 2036*b* are both approximately equal.

Figure 21:
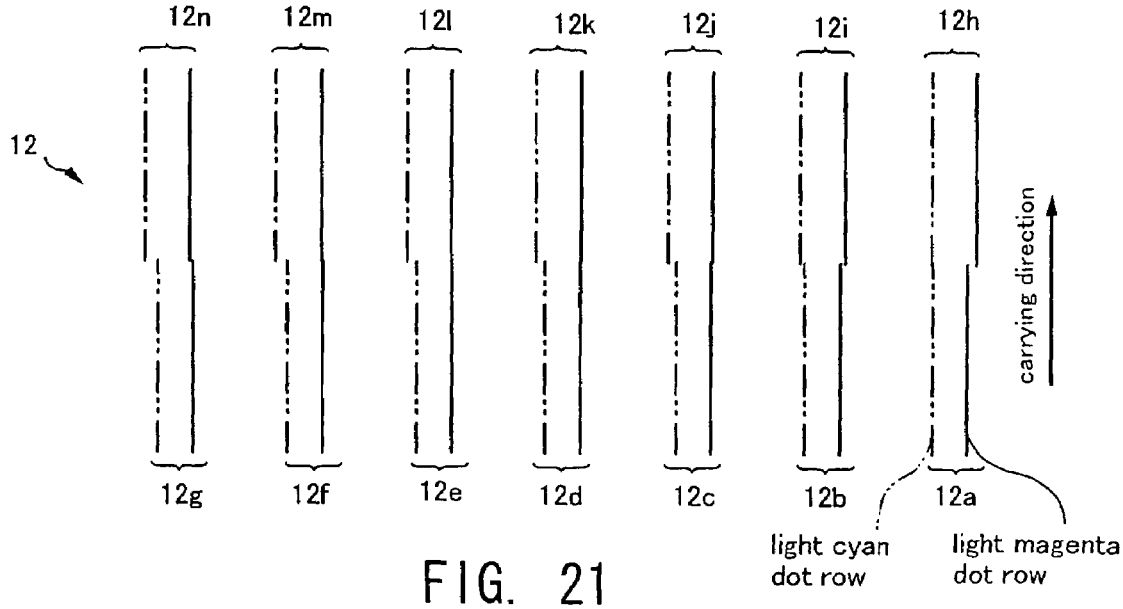
FIG. 21 is a diagram for illustrating a print pattern for determining the optimum output timing when printing is carried out using chromatic color ink.

FIG. 21 is a diagram for illustrating a print pattern for determining the optimum output timing when printing is carried out using chromatic color ink.

The print pattern 12 is printed by first printing a plurality of dot rows at predetermined target positions with the reference print head and then printing a plurality of dot rows with a target print head by successively changing the ejection timing by a slight amount of time, as with the print pattern described in "Adjusting the output timing for when printing is carried out using achromatic color ink" above. For chromatic color ink, however, two nozzle rows will eject ink at the target position. Below, detailed description on aspects that are in common with those regarding the adjustment of the output timing for when printing is performed using achromatic color ink as described above is omitted.

In the forward pass scan movement of the carriage 2028, the reference print head 2036*d* ejects ink from the light cyan nozzle row Nlc and the light magenta nozzle row Nlm with respect to predetermined target positions in the main-scanning direction on the roll paper P to thereby form a first dot row pair 12*a* in the carrying direction. After forming the first dot row pair 12*a*, the reference print head 2036*d* ejects ink, for example, six times at constant time intervals to thereby form a total of seven dot row pairs 12*a* through 12*g* on the upstream side in the carrying direction at appropriate intervals, as shown in FIG. 21.

On the other hand, the target print head 2036*b* forms seven dot row pairs, i.e., an eighth dot row pair 12*h* to a fourteenth dot row pair 12*n*, by changing the ink ejection timing by a slight amount of time and ejecting ink in order to form dots at the same target positions as those of the reference print head 2036*d*. That is, the distance between the light cyan dot row and the light magenta dot row that are formed by the target print head 2036*b* and that form a pair is the same, but the distance in the main-scanning direction between the dot row pairs is changed.

In the print pattern of FIG. 21, the second dot row pair 12*b* formed by the reference print head 2036*d* and the ninth dot row pair 12*i* formed by the target print head 2036*b* are printed such that the amount of positional misalignment in the main-scanning direction between the light cyan dot rows of the dot pairs 12*b* and 12*i* and the amount of positional misalignment in the main-scanning direction between the light magenta dot rows of the dot pairs 12*b* and 12*i* are both approximately equal. The ninth dot row pair 12*i* is the second dot row pair from the eleventh dot row pair 12*k* printed at the output timing to which the target print head 2036*b* was set in advance. Therefore, the output timing of the original drive signal ODRV supplied to the target print head 2036*b* is adjusted, with respect to the output timing set in advance, by an amount of time required for the carriage 2028 to move for 2×*frax*;1;1440 *inch*. I*n* this *way*, the *positions*, in the *main-scanning direction*, of the light cyan and light magenta dot rows formed by the reference print head 2036*d* and the positions, in the main-scanning direction, of the light cyan and light magenta dot rows formed by the target print head 2036*b* will be adjusted to be appropriate. Therefore, it is possible to reduce, as a whole, the positional variation of the dots on the roll paper P and to print images such as natural pictures that are printed using chromatic color ink at a higher image quality.

Further, when printing is carried out using chromatic color ink, there are areas, particularly highlight areas, in which the dot density with respect to the paper face is low. These highlight areas are printed using small dots or by ejecting ink from only some of the nozzles of each nozzle row. In this case, the ink ejection velocity differs, for example, due to tension between the ink and the inner surface of the nozzle because when small dots are used for printing the weight of the ink that is ejected for forming dots is small, or due to the difference in the amount of flow of ink that is supplied to the nozzles in the print head when only some of the nozzles in a nozzle row are used. The difference in ink ejection velocity may cause misalignment between the target position and the position at which the dot is actually formed. Therefore, as regards the print pattern used for adjusting the output timing for when printing is carried out using chromatic color ink, it becomes possible to adjust the output timing to a more appropriate timing by forming the dot rows using small dots or by forming the dot rows with only some of the nozzles of each nozzle row.

In the foregoing embodiment, an example in which ink is ejected based on an original drive signal ODRV output at an output timing that is the same within each print head 2036 was described. It is possible, however, to regard each nozzle row of each print head as one liquid ejecting section group, and to eject ink based on an original drive signal ODRV output at an output timing that is the same within each nozzle row. In this case, the nozzle row that is driven at the reference output timing of the original drive signal ODRV will be either the black nozzle row Nk of the print head 2036*d*, which is closest to the center 2046*a* of the engaging portion 2046, and the yellow nozzle row Ny of the print head 2036*e*, which is also closest to the center 2046*a*. By printing a print pattern in which reference dot rows are formed with either one of these nozzle rows Nk or Ny and in which dot rows are formed with another nozzle row at a shifted ink-ejection timing, it is not only possible to adjust the positions of the dot rows that are formed with different print heads, but it is also possible to adjust the positions at which dots are formed even for dot rows formed by the nozzle rows in the same print head. That is, it is possible to adjust the positions of the dots formed by ink ejected from all of the nozzles, and therefore, it becomes possible to print images with higher quality.

In the present embodiment, the number of print heads is eight. This, however, is not a limitation, and any number of print heads may be provided as long as the number is more than one.

Further, the present embodiment described an example in which the engaging portion 2046 between the pull belt 2032 and the carriage 2028 is positioned approximately at the center of the carriage 2028. The position of the engaging portion 2046, however, is not limited thereto. For example, the pull belt 2032 may be provided below all eight print heads 2036 installed to the carriage 2028, and in this case, the reference print head will be the lowermost print head 2036*h* on the right in FIG. 10, and if a nozzle row is to serve as the reference liquid ejecting section group, then the black nozzle row Nk of the print head 2036*h* will serve as the reference.

Other Considerations

In the foregoing, a liquid ejecting apparatus etc. according to the present invention was explained based on the second embodiment, but the above-described embodiments of the present invention are merely to facilitate the understanding of the present invention, and are in no way meant to limit the present invention. Needless to say, modifications and improvements not parting from the spirit of the present invention are possible, and equivalents thereof are intended to be embraced in the present invention.

Further, print paper such as roll paper was described as an example of a medium, but film, cloth, thin metal sheets, and so forth may be used as the medium.

Furthermore, in the foregoing embodiment, a printing apparatus was described as an example of a liquid ejecting apparatus, but the present invention is not limited to this. For example, technology like that of the foregoing embodiment can also be applied to, for example, color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, or DNA chip manufacturing devices. It is possible to achieve the effects described above because even when the technology of the present invention is applied to such fields it is possible to eject liquid on a medium.

Moreover, in the foregoing embodiment, a color ink-jet printer was described as an example of a liquid ejecting apparatus, but the present invention is not limited thereto, and for example, the present invention can also be applied to monochrome ink-jet printers.

Further, in the foregoing embodiment, ink was described as an example of the liquid, but the present invention is not limited thereto. For example, it is also possible to eject, from the nozzles, liquid (including water) such as metallic materials, organic materials (in particular polymeric materials), magnetic materials, conductive materials, wiring materials, film forming materials, machining liquids, and genetic solutions.

Although the preferred embodiment of the present invention has been described in detail, it should be understood that various changes, substitutions and alterations can be made therein without departing from spirit and scope of the inventions as defined by the appended claims.

What is claimed is:

1. A liquid ejecting apparatus comprising:

a moving member that has at least two liquid ejecting section groups and that is capable of moving in a predetermined direction due to an external force, each of said liquid ejecting section groups including at least two liquid ejecting sections for ejecting liquid droplets to form liquid droplet marks on a medium, each of said liquid ejecting section groups including at least a black nozzle row, a cyan nozzle row, magenta nozzle row and a yellow nozzle row, said liquid ejecting section groups being arranged at different positions from each other in a carrying direction in which said medium is carried;

a reference liquid ejecting section group, among said liquid ejecting section groups, that is driven according to a reference ejection signal therefor at a predetermined reference timing and that is a liquid ejecting section group other than the liquid ejecting section group, among said liquid ejecting section groups, that is the furthest away, in said carrying direction, from a section, in said moving member, to which said external force is applied;

a drive signal generating section that generates a single reference ejection signal that causes said liquid droplets to be ejected from said reference liquid ejecting section group at a predetermined reference timing;

at least one other liquid ejecting section group, among said liquid ejecting section groups, that is driven according to a reference ejection signal therefor at a timing adjusted based on said predetermined reference timing of said reference liquid ejecting section group; and at least one other drive signal generating section that generates the reference ejection signal that causes said liquid droplets to be ejected from said other liquid ejecting section group at a timing adjusted based on said predetermined reference timing of said reference liquid ejecting section group.

2. A liquid ejecting apparatus according to claim 1, wherein said reference liquid ejecting section group is positioned on a side, in a direction intersecting with said predetermined direction, that is close to said section, in said moving member, to which said external force is applied.

3. A liquid ejecting apparatus according to claim 2, wherein said reference liquid ejecting section group is positioned on a side that is close to a center of said section to which said external force is applied.

4. A liquid ejecting apparatus according to claim 1, wherein said liquid ejecting section groups are liquid ejecting section rows, each of said liquid ejecting section rows including said liquid ejecting sections aligned in a row in said carrying direction in which said medium is carried.

5. A liquid ejecting apparatus according to claim 1, wherein said liquid ejecting section groups are liquid ejecting units, each of said liquid ejecting units including at least two liquid ejecting section rows aligned in said predetermined direction, and each of said liquid ejecting section rows including said liquid ejecting sections aligned in a row in said carrying direction in which said medium is carried.

6. A liquid ejecting apparatus according to claim 1, wherein said timing for driving said other liquid ejecting section group is adjusted to make a reference liquid droplet mark row that is taken as a reference and that is formed in said carrying direction, in which said medium is carried, by said reference liquid ejecting section group ejecting liquid at said predetermined reference timing while moving and a liquid droplet mark row that is formed by said other liquid ejecting section group ejecting liquid while moving be continuous with each other.

7. A liquid ejecting apparatus according to claim 6, wherein said liquid ejecting apparatus carries said medium between an action of forming said reference liquid droplet mark row and an action of forming said liquid droplet mark row with said other liquid ejecting section group.

8. A liquid ejecting apparatus according to claim 1, wherein said liquid is ink.

9. A liquid ejecting apparatus according to claim 1, wherein:

each of said liquid ejecting section groups has an achromatic color liquid ejecting section row for ejecting achromatic color ink as said liquid and a chromatic color liquid ejecting section row for ejecting chromatic color ink; and said timing for driving said other liquid ejecting section group is adjusted differently for when said liquid droplet marks are to be formed on said medium by ejecting ink from said achromatic color liquid ejecting section row, and when said liquid droplet marks are to be formed on said medium using said chromatic color liquid ejecting section row.

10. A liquid ejecting apparatus according to claim 9, wherein when said positions of said liquid droplet marks are to be adjusted for performing printing on said medium by ejecting ink from said achromatic color liquid ejecting section row, said timing for driving said other liquid ejecting section group is adjusted according to liquid droplet marks that are formed by the ink ejected from said achromatic color liquid ejecting section row.

11. A liquid ejecting apparatus according to claim 9, wherein:

each of said liquid ejecting section groups has at least two chromatic color liquid ejecting section rows, each for ejecting a different one of at least two chromatic color inks as said liquid; and when said positions of said liquid droplet marks are to be adjusted for performing printing on said medium by ejecting ink from said chromatic color liquid ejecting section rows, said timing for driving said other liquid ejecting section group is adjusted according to liquid droplet mark rows that are formed by the inks ejected from said chromatic color liquid ejecting section rows.

12. A liquid ejecting apparatus according to claim 11, wherein:

the liquid ejecting section rows in a same one of said liquid ejecting section groups are driven based on said single reference ejection signal; and said timing for driving said other liquid ejecting section group is adjusted to make a distance, in said predetermined direction, between the liquid droplet mark rows, among said liquid droplet mark rows formed by ejecting the inks from said chromatic color liquid ejecting section rows, that are formed using ink of one predetermined color and a distance, in said predetermined direction, between the liquid droplet mark rows, among said liquid droplet mark rows formed by ejecting the inks from said chromatic color liquid ejecting section rows, that are formed using ink of another predetermined color be approximately equal.

13. A liquid ejecting apparatus according to claim 12, wherein the inks of the predetermined colors are magenta-type ink and cyan-type ink.

14. A liquid ejecting apparatus according to claim 9, wherein the liquid ejecting sections for ejecting said chromatic color ink to adjust said positions of said liquid droplet marks are a portion of said liquid ejecting sections of said chromatic color liquid ejecting section row.

15. A liquid ejecting apparatus comprising:

a moving member that has at least two ink ejecting units and that is capable of moving in a predetermined direction due to an external force, each of said ink ejecting units including at least two ink ejecting section rows aligned in said predetermined direction, each of said ink ejecting section rows including at least two ink ejecting sections that are for ejecting ink droplets to form ink droplet marks on a medium, each of said liquid ejecting units including at least a black nozzle row, a cyan nozzle row, a magenta nozzle row, and a yellow nozzle row, said liquid ejecting units being arranged at different positions from each other in a carrying direction in which said medium is carried;

a reference ink ejecting unit, among said ink ejecting units, that is driven according to the reference ejection signal therefor at a predetermined reference timing and that is an ink ejecting unit other than the ink ejecting unit, among said ink ejecting units, that is the furthest away, in said carrying direction, from a section, in said moving member, to which said external force is applied;

a drive signal generating unit that generates a single reference ejection signal that causes said liquid droplets to be ejected from said reference liquid ejecting unit at a predetermined reference timing;

at least one other ink ejecting unit, among said ink ejecting units, that is driven according to the reference ejection signal therefor at a timing adjusted based on said predetermined reference timing of said reference ink ejecting unit; and at least one other drive signal generating unit that generates the reference ejection signal that causes said liquid droplets to be ejected from said other liquid ejecting unit at a timing adjusted based on said predetermined reference timing of said reference liquid ejecting unit, wherein:

said reference ink ejecting unit is positioned on a side, in a direction intersecting with said predetermined direction, that is close to a center of a section, in said moving member, to which said external force is applied;

each of said ink ejecting units has an achromatic color ink ejecting section row for ejecting achromatic color ink and at least two chromatic color ink ejecting section rows each for ejecting a different one of at least two chromatic color inks;

a reference ink droplet mark row that is taken as a reference and that is formed in said carrying direction by said reference ink ejecting unit ejecting ink at said predetermined reference timing while moving and an ink droplet mark row that is formed by said other ink ejecting unit ejecting ink while moving are formed, one of either said reference ink droplet mark row or said ink droplet mark row being formed before a carrying action of said medium, and the other being formed after said carrying action;

when said positions of said ink droplet marks are to be adjusted for performing printing on said medium by ejecting ink from said chromatic color ink ejecting section row, said timing for driving said other ink ejecting unit is adjusted according to ink droplet marks that are formed by the ink ejected from said achromatic color ink ejecting section row to make said reference ink droplet mark row and said ink droplet mark row that is formed by said other ink ejecting unit be continuous with each other; and when said positions of said ink droplet marks are to be adjusted for performing printing on said medium by ejecting inks from said chromatic color ink ejecting section rows, said timing for driving said other ink ejecting unit is adjusted to make a distance, in said predetermined direction, between the ink droplet mark rows, among said ink droplet mark rows formed by ejecting the inks from said chromatic color ink ejecting section rows, that are formed using magenta-type ink by a portion of said ink ejecting sections of said ink ejecting section row and a distance, in said predetermined direction, between the ink droplet mark rows, among said ink droplet mark rows formed by ejecting the inks from said chromatic color ink ejecting section rows, that are formed using cyan-type ink by a portion of said ink ejecting sections of said ink ejecting section row be approximately equal.

16. A method of adjusting positions of liquid droplet marks, comprising the steps of:

preparing a liquid ejecting apparatus including a moving member that has at least two liquid ejecting section groups and that is capable of moving in a predetermined direction due to an external force, each of said liquid ejecting section groups including at least two liquid ejecting sections for ejecting liquid droplets to form liquid droplet marks on a medium, each of said liquid ejecting section groups including at least a black nozzle row, a cyan nozzle row, a magenta nozzle row, and a yellow nozzle row, said liquid ejecting section groups being arranged at different positions from each other in a carrying direction in which said medium is carried;

ejecting liquid to form a liquid droplet mark pattern including liquid droplet marks formed by ejecting liquid from the liquid ejecting sections of a reference liquid ejecting section group, among said liquid ejecting section groups, that is driven according to the reference ejection signal therefor at a predetermined reference timing and that is a liquid ejecting section group other than the liquid ejecting section group, among said liquid ejecting section groups, that is the furthest away, in said carrying direction, from a section, in said moving member, to which said external force is applied; and liquid droplet marks formed by ejecting liquid from the liquid ejecting sections of one other liquid ejecting section group, among said liquid ejecting section groups other than said reference liquid ejecting section group, that is driven according to a reference ejection signal therefor at a timing different from said predetermined reference timing; and adjusting the timing of the reference ejection signal for said one other liquid ejecting section group based on said liquid droplet mark pattern.

17. A liquid ejecting system comprising:

a computer; and a liquid ejecting apparatus that is connected to said computer and that includes:

a moving member that has at least two liquid ejecting section groups and that is capable of moving in a predetermined direction due to an external force, each of said liquid ejecting section groups including at least two liquid ejecting sections for ejecting liquid droplets to form liquid droplet marks on a medium, each of said liquid ejecting section groups including at least a black nozzle row, a cyan nozzle row, a magenta nozzle row, and a yellow nozzle row, said liquid ejecting section groups being arranged at different positions from each other in a carrying direction in which said medium is carried;

a reference liquid ejecting section group, among said liquid ejecting section groups, that is driven according to a reference ejection signal therefor at a predetermined reference timing and that is a liquid ejecting section group other than the liquid ejecting section group, among said liquid ejecting section groups, that is the furthest away, in said carrying direction, from a section, in said moving member, to which said external force is applied;

a drive signal generating section that generates a single reference ejection signal that causes said liquid droplets to be ejected from said reference liquid ejecting section group at a predetermined reference timing;

at least one other liquid ejecting section group, among said liquid ejecting section groups, that is driven according to a reference ejection signal therefor at a timing adjusted based on said predetermined reference timing of said reference liquid ejecting section; and at least one other drive signal generating section that generates the reference ejection signal that causes said liquid droplets to be ejected from said other liquid ejecting section group at a timing adjusted based on said predetermined reference timing of said reference liquid ejecting section group.

* * * * *